US008956195B2

(12) United States Patent
Suzuki et al.

(10) Patent No.: US 8,956,195 B2
(45) Date of Patent: Feb. 17, 2015

(54) MARINE VESSEL PROPULSION DEVICE

(71) Applicant: Yamaha Hatsudoki Kabushiki Kaisha, Iwata-shi, Shizuoka (JP)

(72) Inventors: Takayoshi Suzuki, Shizuoka (JP); Noriyoshi Hiraoka, Shizuoka (JP)

(73) Assignee: Yamaha Hatsudoki Kabushiki Kaisha, Shizuoka (JP)

( * ) Notice: Subject to any disclaimer, the term of this patent is extended or adjusted under 35 U.S.C. 154(b) by 117 days.

(21) Appl. No.: 13/670,610

(22) Filed: Nov. 7, 2012

(65) Prior Publication Data

US 2013/0115833 A1 May 9, 2013

(30) Foreign Application Priority Data

Nov. 8, 2011 (JP) ..... 2011-244661

(51) Int. Cl.

| | |
|---|---|
| ***B63H 20/00*** | (2006.01) |
| ***B63H 1/16*** | (2006.01) |
| ***B63H 5/125*** | (2006.01) |
| ***B63H 5/14*** | (2006.01) |
| ***B63H 23/00*** | (2006.01) |

(52) U.S. Cl.

CPC ..... *B63H 20/00* (2013.01); *B63H 1/16* (2013.01); *B63H 5/125* (2013.01); *B63H 5/14* (2013.01); *B63H 23/00* (2013.01); *B63H 2001/165* (2013.01); *B63H 2023/005* (2013.01)

USPC ..... 440/2; 440/6

(58) Field of Classification Search

CPC ..... B63H 20/00; B63H 1/16; B63H 5/125; B63H 5/14; B63H 23/00

USPC ..... 440/2, 6, 62, 67; 310/87, 114; 290/51, 290/52

See application file for complete search history.

(56) References Cited

U.S. PATENT DOCUMENTS

| | | | | |
|---|---|---|---|---|
| 3,914,629 | A | 10/1975 | Gardiner | |
| 5,181,868 | A * | 1/1993 | Gabriel | 440/38 |
| 5,306,183 | A * | 4/1994 | Holt et al. | 440/6 |
| 5,522,335 | A | 6/1996 | Veronesi et al. | |
| 8,146,369 | B2 * | 4/2012 | Walitzki et al. | 290/52 |

(Continued)

FOREIGN PATENT DOCUMENTS

| | | | |
|---|---|---|---|
| CN | 1619441(A) | * | 5/2005 |
| CN | 201082760(Y) | * | 7/2008 |
| DE | 1 781 332 A | | 12/1970 |

(Continued)

OTHER PUBLICATIONS

Official Communication issued in corresponding European Patent Application No. 12190355.3, mailed on Feb. 26, 2013.

(Continued)

*Primary Examiner* — Lars A Olson

(74) *Attorney, Agent, or Firm* — Keating & Bennett, LLP

(57) ABSTRACT

A marine vessel propulsion device includes a bracket that is attachable to a marine vessel, a duct that is rotatable around a steering axis with respect to the bracket, a propeller that is rotatable with respect to the duct around a propeller axis extending in a direction perpendicular or substantially perpendicular to the steering axis, and an electric motor that rotates the propeller. The propeller includes a plurality of blades and a cylindrical rim that surrounds the plurality of blades, and is surrounded by the duct. The electric motor rotates the rim with respect to the duct.

18 Claims, 19 Drawing Sheets

(56) References Cited

U.S. PATENT DOCUMENTS

| | | | | |
|---|---|---|---|---|
| 8,299,669 | B2 * | 10/2012 | Gieras et al. | 310/87 |
| 2007/0253821 | A1 | 11/2007 | Gabriel | |

FOREIGN PATENT DOCUMENTS

| | | | |
|---|---|---|---|
| DE | 39 12910 | A1 | 10/1990 |
| DE | WO2011/029550 | A1 * | 3/2011 |
| EP | 0 928 738 | A2 | 7/1999 |
| EP | 1 876 094 | A2 | 1/2008 |
| FR | 2 829 101 | A1 | 3/2007 |
| JP | 2005-153727 | A | 6/2005 |
| JP | 2009-234513 | A | 10/2009 |

OTHER PUBLICATIONS

Suzuki et al., "Marine Vessel Propulsion Device", U.S. Appl. No. 13/670,613, filed Nov. 7, 2012.

* cited by examiner

MARINE VESSEL PROPULSION DEVICE

BACKGROUND OF THE INVENTION

1. Field of the Invention

The present invention relates to a marine vessel propulsion device.

2. Description of the Related Art

A marine vessel propulsion device provided with an outboard motor into which an engine (internal combustion engine) is built has been known. Japanese Unexamined Patent Application Publication No. 2005-153727 and Japanese Unexamined Patent Application Publication No. 2009-234513 disclose an electrically-operated marine vessel propulsion device provided with an outboard motor into which an electric motor is built instead of an engine. In the electrically-operated marine vessel propulsion device of Japanese Unexamined Patent Application Publication No. 2005-153727, the electric motor is disposed above the surface of the water. In the electrically-operated marine vessel propulsion device of Japanese Unexamined Patent Application Publication No. 2009-234513, the electric motor is disposed in the water in front of a propeller.

SUMMARY OF THE INVENTION

The inventor of preferred embodiments of the present invention described and claimed in the present application conducted an extensive study and research regarding an outboard motor, such as the one described above, and in doing so, discovered and first recognized new unique challenges and previously unrecognized possibilities for improvements as described in greater detail below.

In the arrangement of Japanese Unexamined Patent Application Publication No. 2009-234513, the electric motor is disposed in the water in front of the propeller, and therefore the effective area of the propeller is decreased, and propulsive efficiency is lowered. Additionally, the rotation of the electric motor is transmitted to the propeller without being decelerated. Therefore, when the maximum value of torque to be applied to the propeller is increased, there is a need to use a high-output electric motor, and the electric motor becomes large in size. Therefore, the effective area of the propeller is further decreased, and the resistance of the water applied to a casing with which the electric motor is covered is increased. Therefore, the propulsive efficiency is further lowered.

On the other hand, in the arrangement of Japanese Unexamined Patent Application Publication No. 2005-153727, the electric motor is connected to a drive shaft, and the propeller is connected to a propeller shaft. The drive shaft is connected to the propeller shaft through bevel gears. The rotation of the electric motor is transmitted to the propeller while being decelerated by the bevel gears. Therefore, the maximum value of torque applied to the propeller can be increased by increasing the reduction gear ratio of the bevel gears. However, an increase in the reduction gear ratio of the bevel gears leads to an increase in the size of the bevel gears, and therefore a lower case containing the bevel gears becomes large in size. Therefore, the resistance of water applied to the lower case is increased, and the propulsive efficiency is lowered.

In order to overcome the previously unrecognized and unsolved challenges described above, one preferred embodiment of the present invention provides a marine vessel propulsion device that includes a bracket that is attachable to a marine vessel, a duct that is rotatable around a steering axis with respect to the bracket, a propeller that is rotatable with respect to the duct around a propeller axis extending in a direction perpendicular or substantially perpendicular to the steering axis, and an electric motor that rotates the propeller. The propeller includes a plurality of blades and a cylindrical rim that surrounds the blades, and is surrounded by the duct. The electric motor rotates the rim with respect to the duct.

According to this arrangement, the electric motor rotates the propeller by rotating the rim. The rim surrounds the blades, and therefore the diameter of the rim is larger. The electric motor rotates a portion having this larger diameter, and therefore a high torque can be generated by a small output.

The electric motor may be incorporated into a portion of the duct and a portion of the rim, or may be an external motor connected to the rim through a transmission mechanism. Preferably, in either case, the electric motor (rotor and stator) is disposed so as not to coincide with the blades of the propeller when seen from either of the front and rear sides along the propeller axis. In other words, preferably, the electric motor is positioned outside the outermost edge of the blades.

If the electric motor is incorporated into a portion of the duct and a portion of the rim, i.e., if the stator and the rotor are defined by a portion of the duct and a portion of the rim, respectively, the diameter of the rotor can be enlarged by enlarging the diameter of the rim. As a result, the output of the electric motor can be increased. Additionally, the blades are disposed inside the rim (rotor), and therefore the propulsive efficiency can be prevented from being lowered due to the enlarged electric motor.

If the electric motor is an external motor, the electric motor may rotate the blades by rotating a driven gear that rotates together with the rim. The blades are disposed inside the rim (driven gear). Therefore, even if the reduction gear ratio of the driven gear is increased by enlarging the driven gear, a decrease in propulsive efficiency can be prevented. Therefore, the marine vessel propulsion device can prevent a decrease in propulsive efficiency, and can output a high torque.

The electric motor may be a direct drive motor that directly drives the rim, or may be an indirect drive motor that drives the rim through the transmission mechanism. If the electric motor is a direct drive motor, power loss is reduced, and therefore propulsive efficiency can be made even higher. On the other hand, if the electric motor is an indirect drive motor, there is no need to dispose the electric motor around the rim, and therefore the degree of freedom in arranging the electric motor can be increased.

If the electric motor is a direct drive motor, the electric motor may include a stator defined by at least one portion of the duct and a rotor defined by at least one portion of the rim. In this case, the rim may include a magnet that defines at least one portion of the rotor. In other words, the electric motor may be a permanent-magnet type direct-current motor including a permanent-magnet rotor. Alternatively, the electric motor may be a reluctance motor including a salient poled rotor.

On the other hand, if the electric motor is an indirect drive motor, the marine vessel propulsion device may additionally include a gear transmission mechanism that transmits the power of the electric motor to the rim. The gear transmission mechanism may include a driving gear that rotates together with the electric motor and a driven gear to which the rotation of the driving gear is transmitted and that rotates together with the rim. According to this arrangement, the driving gear is connected to the motor shaft of the electric motor, and the driving gear and the motor shaft rotate together. The rotation of the driving gear is transmitted to the driven gear. As a result, the power of the electric motor is transmitted to the rim. Therefore, the blades and the rim rotate around the propeller axis with respect to the duct.

Preferably, the gear transmission mechanism is disposed so as not to coincide with the blades of the propeller when seen from either of the front and rear sides along the propeller axis. In other words, preferably, the gear transmission mechanism is positioned outside the outermost edge of the blades.

The propeller may include contra-rotating propellers. In other words, the propeller may include a front propeller and a rear propeller that are rotationally driven in mutually opposite directions by the electric motor. The front propeller and the rear propeller are arranged side-by-side in a direction along the propeller axis. The front propeller may include a plurality of front blades and a cylindrical front rim that surrounds the plurality of front blades. Likewise, the rear propeller may include a plurality of rear blades and a cylindrical rear rim that surrounds the plurality of rear blades. According to this arrangement, propulsive efficiency (in particular, propulsive efficiency at a low speed) can be increased.

If the propeller includes contra-rotating propellers, the electric motor may include a front electric motor that rotates the front propeller by rotating the front rim with respect to the duct. The electric motor may additionally include a rear electric motor that rotates the rear propeller by rotating the rear rim with respect to the duct. In this case, the front electric motor may include a front stator defined by at least one portion of the duct and a front rotor defined by at least one portion of the front rim. Likewise, the rear electric motor may include a rear stator defined by at least one portion of the duct and a rear rotor defined by at least one portion of the rear rim. In other words, the front electric motor and the rear electric motor may be direct drive motors, respectively.

If the propeller includes contra-rotating propellers, the electric motor may be an indirect drive motor. In other words, the marine vessel propulsion device may additionally include a gear transmission mechanism that transmits power of the electric motor to the front rim and to the rear rim. The gear transmission mechanism may include a driving gear that rotates together with the electric motor, a front driven gear to which rotation of the driving gear is transmitted and that rotates together with the front rim, and a rear driven gear to which rotation of the driving gear is transmitted and that rotates together with the rear rim. Preferably, the gear transmission mechanism is disposed so as not to coincide with the blades of the propeller when seen from either of the front and rear sides along the propeller axis. In other words, preferably, the gear transmission mechanism is positioned outside the outermost edge of the blades.

According to this arrangement, the driving gear is connected to the motor shaft of the electric motor, and the driving gear and the motor shaft rotate together. The rotation of the driving gear is transmitted to the front driven gear and the rear driven gear. As a result, the front driven gear and the rear driven gear rotate in mutually opposite directions. Therefore, the front rim and the rear rim rotate in mutually opposite directions with respect to the duct. Therefore, the front propeller and the rear propeller rotate in mutually opposite directions with respect to the duct.

The marine vessel propulsion device may be arranged so that it can change the pitch of the propeller (i.e., advancement distance made by one rotation of the propeller). In detail, the rim may include a front rim and a rear rim that support the blades so that an inclination angle of the blades with respect to the propeller axis changes in response to relative rotation around the propeller axis. The front rim and the rear rim are arranged side-by-side in a direction along the propeller axis. Additionally, the electric motor may include a front electric motor that rotates the front rim around the propeller axis and a rear electric motor that rotates the rear rim around the propeller axis.

According to this arrangement, the front electric motor and the rear electric motor rotate the blades with respect to the duct by rotating the front rim and the rear rim around the propeller axis. Additionally, the front electric motor and the rear electric motor relatively rotate the front rim and the rear rim around the propeller axis. As a result, the inclination angle of the blades with respect to the propeller axis changes, and the pitch of the propeller changes. Therefore, the electric motor can change characteristics of the propeller between a high torque type and a high output type.

The pitch of the propeller may be adjusted in a two-step manner including a high torque pitch and a high output pitch, or may be adjusted in a non-stepped manner between these two pitches. If the propeller pitch is adjusted in a non-stepped manner, the marine vessel propulsion device may further include a control device that controls the front electric motor and the rear electric motor. According to this arrangement, the control device can control the relative rotation amount of the front rim and the relative rotation amount of the rear rim by controlling the front electric motor and the rear electric motor. Therefore, the control device can adjust the propeller pitch in a non-stepped manner.

If the marine vessel propulsion device is arranged so that it can change the propeller pitch, the marine vessel propulsion device may further include a rotation amount restricting portion that restricts a relative rotation amount of the front rim and a relative rotation amount of the rear rim. According to this arrangement, the relative rotation amount of the front rim and that of the rear rim are restricted, and therefore the amount of change of the propeller pitch is also restricted. Therefore, the electric motor can change the propeller pitch within the range of the relative rotation amount of the front rim and that of the rear rim that are allowed by the rotation amount restricting portion.

The rotation amount restricting portion may include a supporting portion disposed at either one of the rim and the blades and a supported portion that is disposed at a remaining one of the rim and the blades and that defines a long hole in which the supporting portion is inserted.

According to this arrangement, the rim and the blades are connected by the supporting portion and the supported portion. The supporting portion is inserted in the long hole defined by the supported portion. The supporting portion and the supported portion can relatively move in the longitudinal direction of the long hole in a state in which the supported portion is supported by the supporting portion. The rim and the blade relatively move in response to the relative movement of the supporting portion and that of the supported portion. When the supporting portion and the supported portion (inner surface of the long hole) come into contact with each other, the relative movement of the supporting portion and that of the supported portion are restricted. Therefore, the relative movement of the rim and that of the blade are restricted. In other words, the movement of the front rim with respect to the blade is restricted, and the movement of the rear rim with respect to the blade is restricted. In other words, the front rim and the rear rim undergo restrictions on their relative movements with respect to a shared member (blades), and hence undergo restrictions on their relative rotations. As a result, the relative rotation amount of the front rim and that of the rear rim are restricted.

If the marine vessel propulsion device includes the rotation amount restricting portion, the propeller may further include a front rotational shaft that extends along the propeller axis and that rotates around the propeller axis together with the front rim and a rear rotational shaft that extends along the propeller axis and that rotates around the propeller axis together with the rear rim. In this case, the rotation amount restricting portion may include a front engagement portion and a rear engagement portion that are disposed at the front rotational shaft and at the rear rotational shaft, respectively, and that engage with each other so as to be relatively rotatable around the propeller axis in a predetermined angular range.

According to this arrangement, the front engagement portion is disposed at the front rotational shaft of the propeller, and the rear engagement portion is disposed at the rear rotational shaft of the propeller. Therefore, the front engagement portion rotates around the propeller axis together with the front rotational shaft, and the rear engagement portion rotates around the propeller axis together with the rear rotational shaft. The front engagement portion and the rear engagement portion engage with each other so as to be relatively rotatable around the propeller axis in a predetermined angular range. Therefore, when the front engagement portion and the rear engagement portion come into contact with each other, the relative rotation of the front rim and that of the rear rim are restricted. As a result, the relative rotation amount of the front rim and that of the rear rim are restricted.

The marine vessel propulsion device may additionally include a steering shaft that extends along the steering axis and that is rotatable around the steering axis with respect to the bracket. In this case, the duct may be attached to a lower portion of the steering shaft, and may be rotatable around the steering axis together with the steering shaft.

The marine vessel propulsion device may additionally include an illuminant that emits light. The light emission state, such as brightness or lighting time, may be changed in accordance with the rotation state of the propeller. The illuminant may be disposed on either one of the duct and the propeller, or may be disposed on both of the duct and the propeller. The illuminant may be an electric lamp, or may be an LED (light emitting diode). In this case, electric power that is supplied to the illuminant may be electric power supplied from a motor power source that supplies electric power to the electric motor, or may be electric power supplied from a dedicated power supply system that supplies electric power to the illuminant.

If the marine vessel propulsion device includes the power supply system, the electric motor may include a stator defined by at least one portion of the duct and a rotor defined by at least one portion of the rim. The marine vessel propulsion device may further include a power generation coil that rotates around the propeller axis together with the rim, and the power generation coil may have at least one portion attached to the rim at a position at which the one portion faces the stator. In other words, the power supply system may include the power generation coil. In this case, the illuminant may be connected to the power generation coil and be disposed on the propeller.

According to this arrangement, the power generation coil is attached to the rim, and the illuminant is connected to the power generation coil. At least one portion of the power generation coil faces the stator. Therefore, when the electric motor rotates the propeller (the rim), a magnetic flux passing through the power generation coil changes, and an electric current (an induced current) is generated in the power generation coil. As a result, the illuminant emits light. The electric current generated in the power generation coil changes in accordance with the rotation speed of the propeller. Additionally, when the propeller is rotated with a high torque, electric power supplied to the stator is greater than with a low torque even if the rotation speed of the propeller is the same, and therefore the electric current generated in the power generation coils is increased. Therefore, the light emission state of the illuminant changes in accordance with the rotation state of the propeller including its rotation speed and torque. A member (power generation coil) that rotates together with the propeller generates electric power in this way, and therefore electric power can be reliably supplied to the illuminant even if the illuminant is disposed on the propeller. In other words, there is no need to provide complex wiring that extends from a fixing portion (duct) to a rotational body (propeller).

If the marine vessel propulsion device includes the power supply system, the marine vessel propulsion device may further include a power generation coil that is attached to the rim and that rotates around the propeller axis together with the rim and a power generation magnet that is attached to the duct and that faces the power generation coil. In other words, the power supply system may include a dedicated coil and a dedicated magnet. In this case, the illuminant may be connected to the power generation coil, and may be disposed on the propeller. According to this arrangement, the power generation coil is attached to the rim, and the power generation magnet is attached to the duct. Additionally, the power generation coil and the power generation magnet face each other. Therefore, when the electric motor rotates the propeller (rim), an electric current is generated in the power generation coil, and the illuminant emits light in a light emission state corresponding to the rotation state of the propeller.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Propellers according to the following preferred embodiments are preferably rotatable in a normal rotation direction and in a reverse rotation direction. The normal rotation direction may be a clockwise direction (i.e., right-handed rotation direction) when the propeller is seen from behind, or may be a counterclockwise direction (i.e., left-handed rotation direction) when the propeller is seen from behind. Hereinafter, the clockwise direction of the propeller seen from behind is defined as the normal rotation direction of the propeller, and the counterclockwise direction of the propeller seen from behind is defined as the reverse rotation direction of the propeller.

Figure 1A:
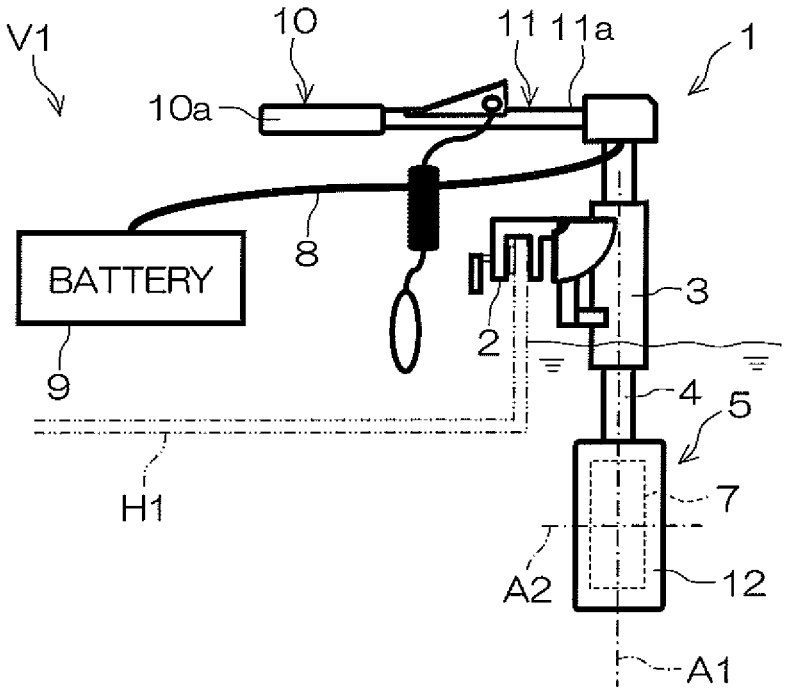
FIG. 1A is a side view of a marine vessel propulsion device according to a first preferred embodiment of the present invention.
Figure 1B:
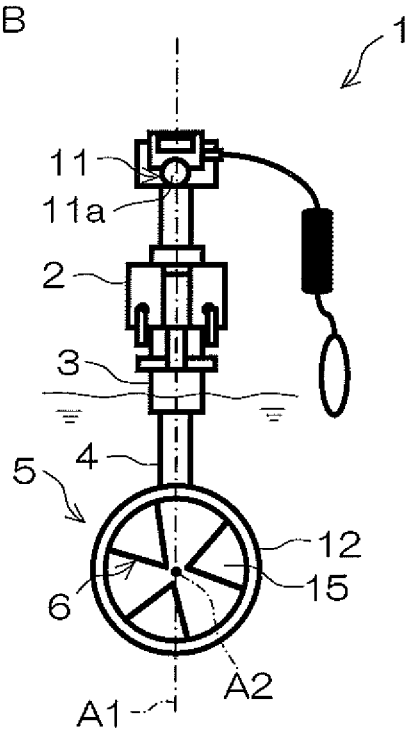
FIG. 1B is a front view of the marine vessel propulsion device shown in FIG. 1A.
Figure 2:
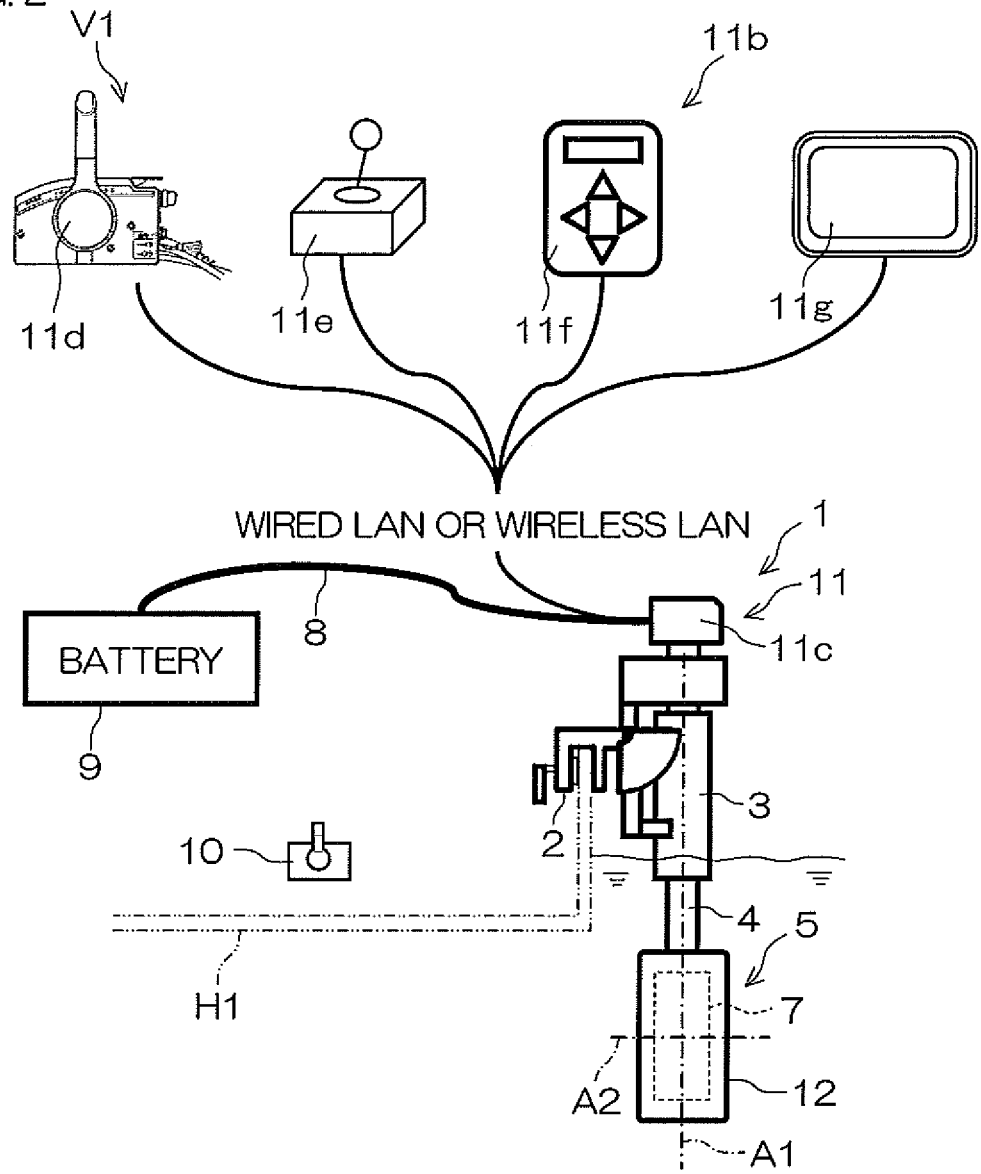
FIG. 2 is a side view of the marine vessel propulsion device according to the first preferred embodiment of the present invention.

FIG. 1A is a side view of a marine vessel propulsion device 1 according to a first preferred embodiment of the present invention, and FIG. 1B is a front view of the marine vessel propulsion device 1 shown in FIG. 1A. FIG. 2 is a side view of the marine vessel propulsion device 1 according to the first preferred embodiment of the present invention.

As shown in FIG. 1A and FIG. 2, the marine vessel propulsion device 1 includes a bracket 2 that is attachable to the stern of a marine vessel V1, a steering tube 3 supported by the bracket 2, a steering shaft 4 supported by the steering tube 3, and a propulsion unit 5 supported by the steering shaft 4.

As shown in FIG. 1A and FIG. 2, the steering tube 3 and the steering shaft 4 are disposed behind a hull H1. The steering tube 3 and the steering shaft 4 extend along a steering axis A1 that is substantially vertical. The steering shaft 4 is inserted in the steering tube 3. The steering shaft 4 is rotatably supported by the steering tube 3 around the steering axis A1 with respect to the bracket 2. The upper end of the steering shaft 4 protrudes upwardly from the steering tube 3. The lower end of the steering shaft 4 protrudes downwardly from the steering tube 3.

As shown in FIG. 1A and FIG. 2, the propulsion unit 5 is connected to the lower end of the steering shaft 4. The propulsion unit 5 rotates around the steering axis A1 together with the steering shaft 4. The propulsion unit 5 generates a thrust force. The propulsion unit 5 is disposed in the water outside the vessel. As shown in FIG. 1B, the propulsion unit 5 includes a propeller 6 that generates the thrust force. As shown in FIG. 1A and FIG. 2, the propulsion unit 5 additionally includes an electric motor 7 that rotates the propeller 6 around a propeller axis A2 that extends in a front-rear direction perpendicular or substantially perpendicular to the steering axis A1. The electric motor 7 is connected to a motor ECU (Electronic Control Unit) 13 described below. The motor ECU 13 is connected to a battery 9 disposed inside the vessel preferably via a wire 8. The wire 8 extends from the inside of the vessel to the inside of the steering shaft 4.

As shown in FIG. 1A and FIG. 2, the marine vessel propulsion device 1 additionally includes an output adjusting device 10 that performs the output adjustment of the marine vessel propulsion device 1 and a steering device 11 that steers the marine vessel V1. The output adjusting device 10 is connected to the propulsion unit 5 (in detail, connected to the motor ECU 13). The output adjusting device 10 includes a control lever disposed inside the vessel. The control lever is operated by a vessel operator. The output adjusting device 10 transmits an output command that has been input to the control lever to the propulsion unit 5. Based on the output command input from the control lever, the propulsion unit 5 generates the thrust force. On the other hand, the steering device 11 rotates the propulsion unit 5 right-handedly and left-handedly around the steering axis A1 by rotating the steering shaft 4 around the steering axis A1. The steering device 11 may be a mechanically-operated steering device, or may be an electrically-operated steering device.

If the steering device 11 is a mechanically-operated steering device, the steering device 11 may include a tiller handle

11*a* that is operated by the vessel operator as shown in FIG. 1A. The tiller handle 11*a* is connected to the upper end of the steering shaft 4. The steering shaft 4 rotates around the steering axis A1 together with the tiller handle 11*a*. If the steering device 11 includes the tiller handle 11*a*, the output adjusting device 10 may include a throttle grip 10*a* disposed at the forward end of the tiller handle 11*a*. The throttle grip 10*a* is rotatable around a central axis of the tiller handle 11*a*, and is operated by the vessel operator.

If the steering device 11 is a mechanically-operated steering device, the steering device 11 may include a remote control unit disposed inside the vessel and a push-pull cable through which the operation of the remote control unit is transmitted to the steering shaft 4 (not shown in the figures). When the remote control unit is operated by the vessel operator, the operation of the remote control unit is transmitted to the steering shaft 4. As a result, the steering shaft 4 rotates around the steering axis A1.

If the steering device 11 is an electrically-operated steering device, the steering device 11 may include a remote control unit 11*b* disposed inside the vessel and a steering unit 11*c* that rotates the steering shaft 4 around the steering axis A1 in response to the operation of the remote control unit 11*b* as shown in FIG. 2. For example, the steering unit 11*c* preferably includes a motor (not shown) that rotates the steering shaft 4 around the steering axis A1 and a control device (not shown) that controls the motor. The control device rotates the steering shaft 4 around the steering axis A1 by controlling the motor based on a command input from the remote control unit 11*b*. The command from the remote control unit 11*b* is sent to the steering unit 11*c* preferably via wired communication or wireless communication.

As shown in FIG. 2, the remote control unit 11*b* may include a remote control lever 11*d* tiltable back and forth, or may include a joystick 11*e* tiltable back, forth, left and right. As shown in FIG. 2, the remote control unit 11*b* may additionally include a wireless remote controller 11*f* including four buttons, for example, or may additionally include a touch panel 11*g* that communicates with the steering unit 11*c* through a data communication network such as the Internet, for example. Of course, the output adjusting device 10 may include devices other than the above-mentioned devices. In other words, the arrangement of the output adjusting device 10 is not limited to the above-described one.

Figure 3:
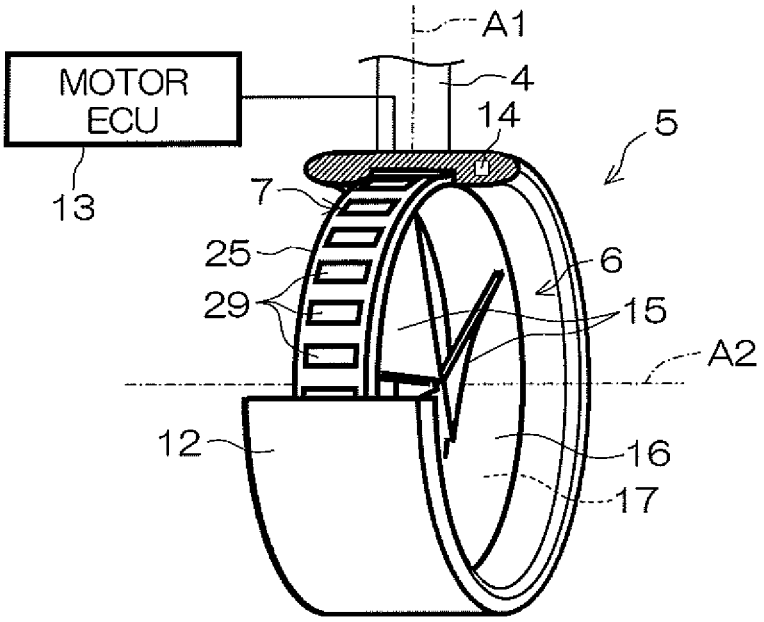
FIG. 3 is a partial sectional view of a propulsion unit according to the first preferred embodiment of the present invention.
Figure 4:
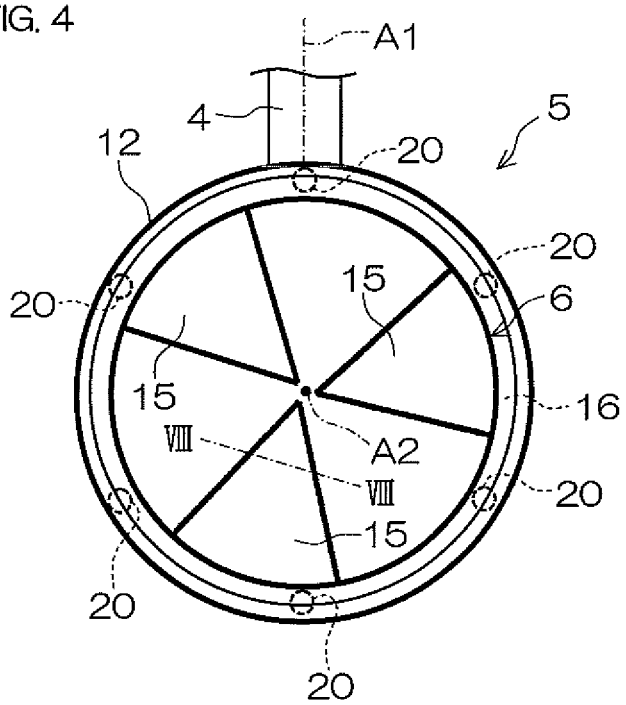
FIG. 4 is a rear view of the propulsion unit according to the first preferred embodiment of the present invention.
Figure 5A:
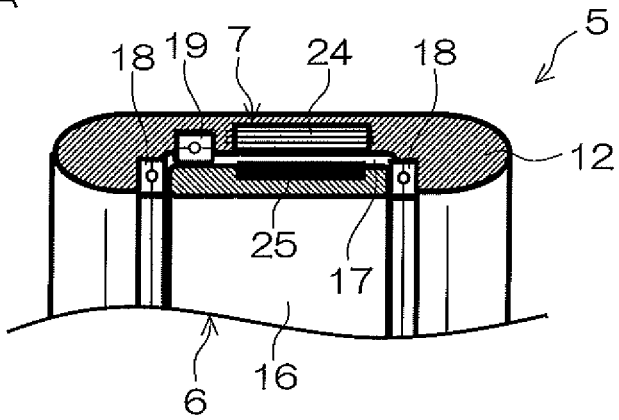
FIG. 5A is a sectional view of an outer peripheral portion of the propulsion unit according to the first preferred embodiment of the present invention.
Figure 5B:
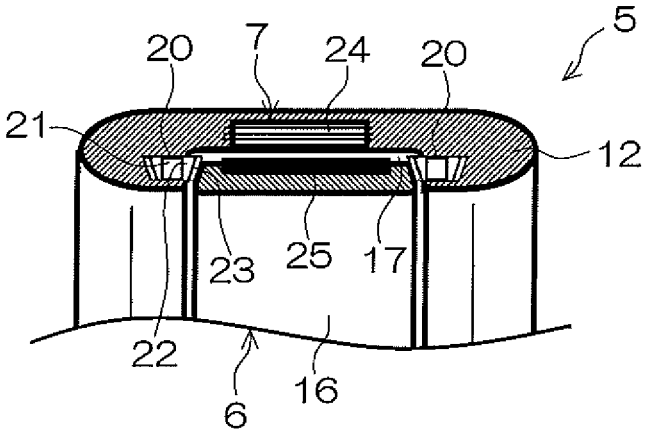
FIG. 5B is a sectional view of the outer peripheral portion of the propulsion unit according to the first preferred embodiment of the present invention.

FIG. 3 is a partial sectional view of the propulsion unit 5. FIG. 4 is a rear view of the propulsion unit 5. FIG. 5A and FIG. 5B are sectional views of an outer peripheral portion of the propulsion unit 5.

As shown in FIG. 3, the propulsion unit 5 includes the propeller 6, the electric motor 7, both of which have been described above, a cylindrical duct 12 that surrounds the propeller 6 around the propeller axis A2, the motor ECU 13 that controls the electric motor 7, and a motor rotation angle detector 14 that detects the rotation angle of the electric motor 7. The duct 12 is connected to the steering shaft 4 such that the duct 12 extends in the front-rear direction. The motor ECU 13 may be disposed inside the steering shaft 4, or may be disposed inside the vessel. The motor rotation angle detector 14 is disposed in the duct 12. The propeller 6 is held by the duct 12. The propeller 6 and the duct 12 are disposed coaxially.

As shown in FIG. 3, the propeller 6 includes a plurality of blades 15 rotatable around the propeller axis A2 and a cylindrical rim 16 that surrounds the blades 15. The blades 15 are spaced apart in the circumferential direction of the propeller 6. As shown in FIG. 4, the blades 15 extend radially in the radial direction of the rim 16 inwardly from the rim 16 toward the propeller axis A2. The rim 16 surrounds an outer end (in the radial direction) of each of the blades 15. For example, each blade 15 preferably has a substantially triangular shape that extends from an inner peripheral surface of the rim 16 toward the propeller axis A2. The blades 15 may be a flat plate, or may be a curved plate including a curved portion. The outer ends (i.e., end on the side of the rim 16) of the blades 15 are fixed to the rim 16. Therefore, the blades 15 and the rim 16 are rotatable together around the propeller axis A2.

As shown in FIG. 3, the rim 16 surrounds the propeller axis A2 inside the duct 12. The central axis of the rim 16 and that of the duct 12 are disposed about the propeller axis A2. As shown in FIG. 5A and FIG. 5B, the duct 12 is wider in the direction of the propeller axis A2 than the rim 16. The rim 16 is contained in an annular groove 17 provided in the inner peripheral portion of the duct 12. The annular groove 17 is recessed from the inner peripheral surface of the duct 12, and is continuous over its whole circumference. The rim 16 is rotatable around the propeller axis A2 with respect to the duct 12 in a state of being contained in the annular groove 17. Therefore, the propeller 6 is rotatable around the propeller axis A2 with respect to the duct 12.

The rim 16 is held by the duct 12 with a plurality of bearings arranged therebetween. As shown in FIG. 5A, the rim 16 may be held by the duct 12 with two thrust bearings 18 and one radial bearing 19 arranged therebetween. Alternatively, as shown in FIG. 5B, the rim 16 may be held by the duct 12 with a plurality of tapered roller bearings 20 arranged therebetween. The thrust bearing 18 and the radial bearing 19 may be ball bearings, or may be roller bearings, or may be different types of bearings.

As shown in FIG. 5A, the front thrust bearing 18 is disposed between a front end surface of the rim 16 and the duct 12, and the rear thrust bearing 18 is disposed between a rear end surface of the rim 16 and the duct 12. The radial bearing 19 is disposed between an outer peripheral surface of the rim 16 and the duct 12. The two thrust bearings 18 support the rim 16 rotatably around the propeller axis A2, and restrict an amount of movement of the rim 16 in the axial direction (i.e., a direction along the propeller axis A2). The radial bearing 19 supports the rim 16 rotatably around the propeller axis A2, and restricts an amount of movement of the rim 16 in the radial direction. Therefore, the movement amount of the propeller 6 in the axial direction and the movement amount thereof in the radial direction are restricted by the thrust bearings 18 and the radial bearing 19.

On the other hand, the tapered roller bearings 20 are preferably arranged as a plurality of pairs. As is understood from a combination of FIG. 4 and FIG. 5B, the tapered roller bearings 20 serving as a pair are spaced back and forth so as to coincide with each other when seen from the front-rear direction. As shown in FIG. 5B, the front tapered roller bearing 20 is disposed between the front end surface of the rim 16 and the duct 12, whereas the rear tapered roller bearing 20 is disposed between the rear end surface of the rim 16 and the duct 12. As shown in FIG. 4, the pairs of tapered roller bearings 20 are spaced apart in the circumferential direction.

As shown in FIG. 5B, the tapered roller bearing 20 includes a support shaft 21 held by the duct 12, an inner ring 22 that surrounds the support shaft 21, and a plurality of rollers 23 disposed around the inner ring 22. The rollers 23 are held by an annular retainer (not shown). Each roller 23 is rotatable around the inner ring 22 while rotating around its central axis (while turning on its own central axis). Each roller 23 is in contact with the front end surface or the rear end surface of the rim 16. The tapered roller bearings 20 support the rim 16 so as to be rotatable around the propeller axis A2, and restrict the amount of movement of the rim 16 in the axial direction and that of movement of the rim 16 in the radial direction. Therefore, the amount of movement of the propeller 6 in the axial direction and that of movement of the propeller 6 in the radial direction are restricted by the tapered roller bearings 20.

Figure 6A:
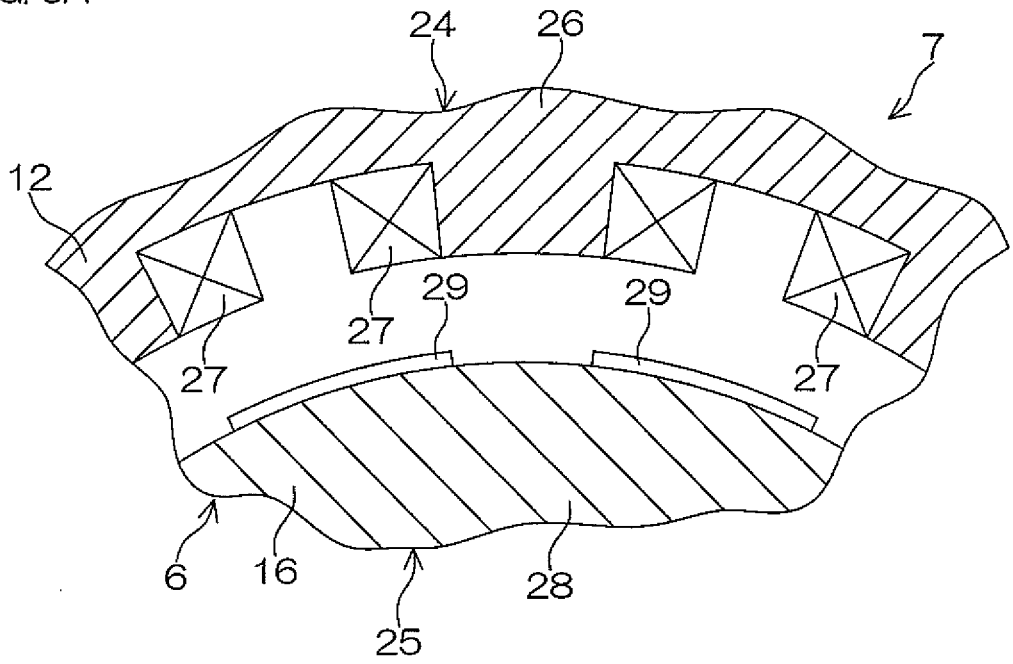
FIG. 6A is a sectional view of a portion of an electric motor according to the first preferred embodiment of the present invention.
Figure 6B:
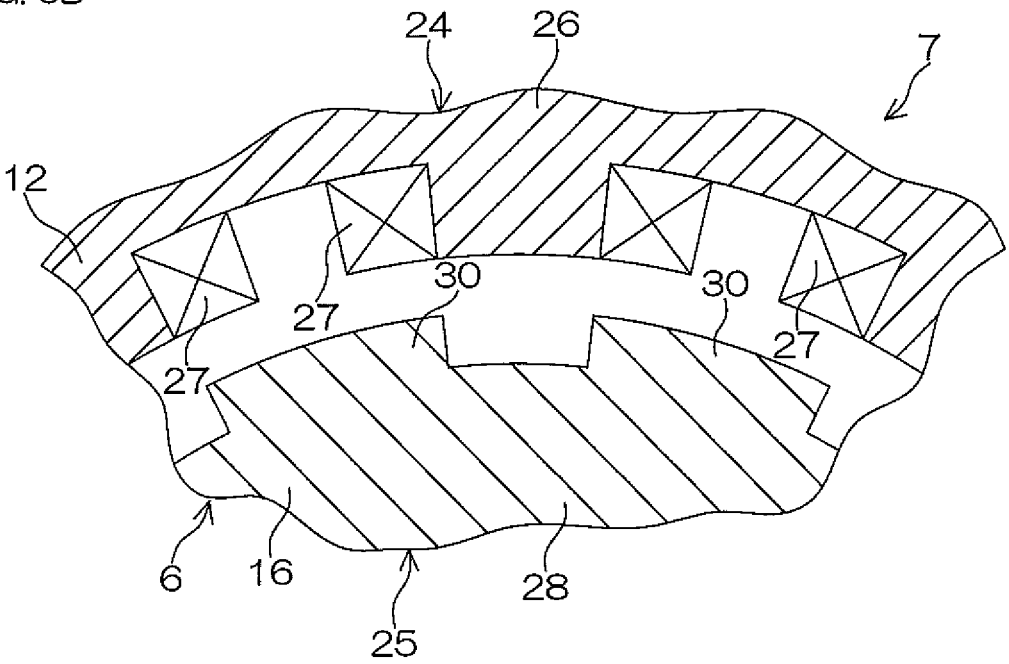
FIG. 6B is a sectional view of the portion of the electric motor according to the first preferred embodiment of the present invention.

FIG. 6A and FIG. 6B are sectional views showing a portion of the electric motor 7. The electric motor 7 is hereinafter described with reference to FIG. 5A to FIG. 6B.

As shown in FIG. 5A and FIG. 5B, the electric motor 7 includes an annular stator 24 defined by a portion of the duct 12 and a cylindrical rotor 25 defined by a portion of the rim 16. In other words, the duct 12 includes the stator 24 disposed between the outer peripheral surface of the duct 12 and a bottom surface of the annular groove 17, and the rim 16 includes the rotor 25 disposed at an outer peripheral portion of the rim 16. The stator 24 and the rotor 25 surround the propeller axis A2. The stator 24 and the rotor 25 face each other in the radial direction of the propeller 6 with a space between the stator 24 and the rotor 25. As shown in FIG. 6A and FIG. 6B, the stator 24 includes an annular stator core 26 preferably made of a soft magnetic material, such as a magnetic steel sheet, and a plurality of coils 27 that are wound onto the stator core 26.

As shown in FIG. 6A, the rotor 25 may be a permanent-magnet rotor that includes a cylindrical rotor core 28 made of a soft magnetic material and a plurality of magnets 29 held by the rotor core 28. In other words, the electric motor 7 may be a permanent-magnet type direct-current motor. Alternatively, as shown in FIG. 6B, the rotor 25 may be a cylindrical salient poled rotor that includes a plurality of salient poles 30 spaced apart in the circumferential direction of the propeller 6 and that is preferably made of a soft magnetic material. In other words, the electric motor 7 may be a switched reluctance motor. Without being limited to these types of motors, the electric motor 7 may be a direct-current motor provided with a brush, or may be a brushless motor, or may be another type of motor.

As shown in FIG. 6A, the coils 27 are arranged in the circumferential direction of the propeller 6. The coils 27 define an annular row that surrounds the propeller axis A2. Likewise, the magnets 29 are arranged in the circumferential direction of the propeller 6, and define an annular row that surrounds the propeller axis A2. The coils 27 may surround the propeller axis A2, and may define a plurality of annular rows arranged in the axial direction of the propeller 6. Likewise, the magnets 29 may surround the propeller axis A2, and may define a plurality of annular rows arranged in the axial direction of the propeller 6. For example, two annular rows arranged side-by-side in the axial direction of the propeller 6 may be defined by the coils 27, the number of windings of which is reduced to half thereof. According to this arrangement, it is possible to reduce the thickness of the electric motor 7 in the radial direction while minimizing a change in the maximum output of the electric motor 7.

The electric motor 7 rotates the rim 16 around the propeller axis A2 with respect to the duct 12 by causing the stator 24 to rotate the rotor 25 around the propeller axis A2. As a result, the blades 15 rotate around the propeller axis A2 with respect to the duct 12. The electric motor 7 can perform normal rotation and reverse rotation. When the electric motor 7 rotates the rotor 25 in the normal rotation direction, the propeller 6 also rotates in the normal rotation direction, and a thrust force in the forward direction is generated. On the contrary, when the electric motor 7 rotates the rotor 25 in the reverse rotation direction, the propeller 6 also rotates in the reverse rotation direction, and a thrust force in the backward direction (i.e., in the reverse direction) is generated. Based on an output command that has been input from the output adjusting device 10 (see FIG. 1A), the motor ECU 13 (see FIG. 3) controls the power supply to the stator 24. In other words, based on an output generated by the motor rotation angle detector 14 (see FIG. 3), the motor ECU 13 controls the power supply to the stator 24, and hence controls the rotation direction and the rotation speed of the rotor 25. As a result, the marine vessel V1 is propelled in a direction based on the output command and at a speed based on the output command.

Figure 7A:
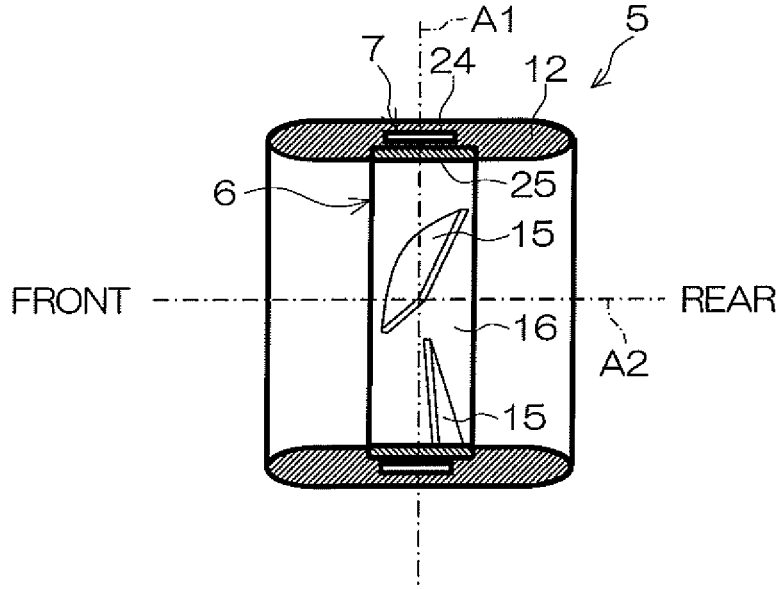
FIG. 7A is a sectional view of the propulsion unit according to the first preferred embodiment of the present invention.
Figure 7B:
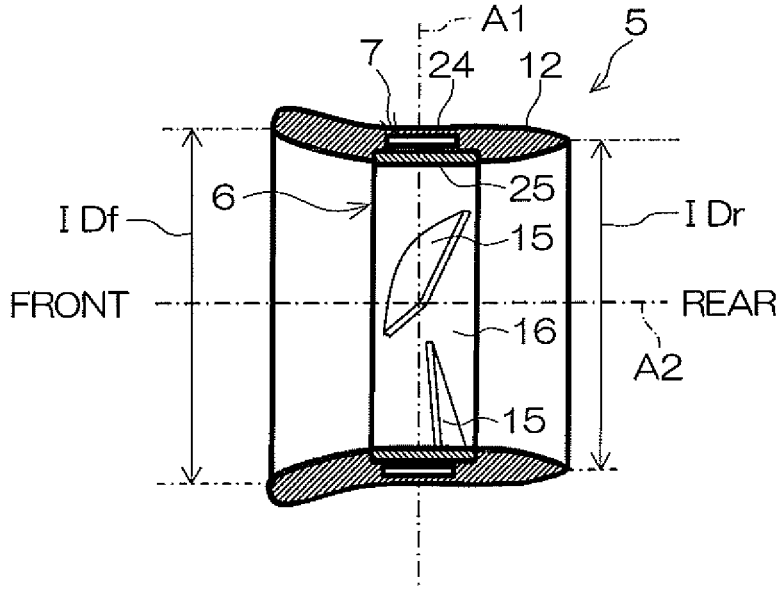
FIG. 7B is a sectional view of the propulsion unit according to the first preferred embodiment of the present invention.
Figure 8A:
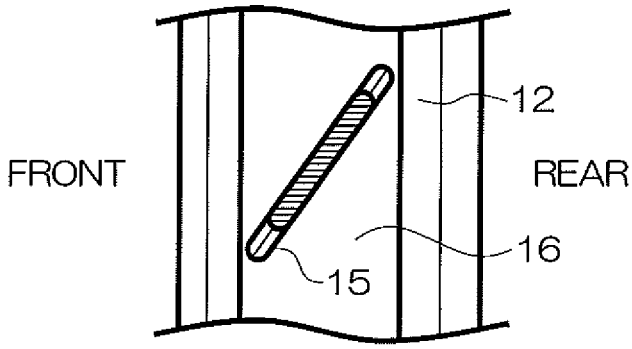
FIG. 8A is a sectional view of a blade taken along line VIII-VIII in FIG. 4.
Figure 8B:
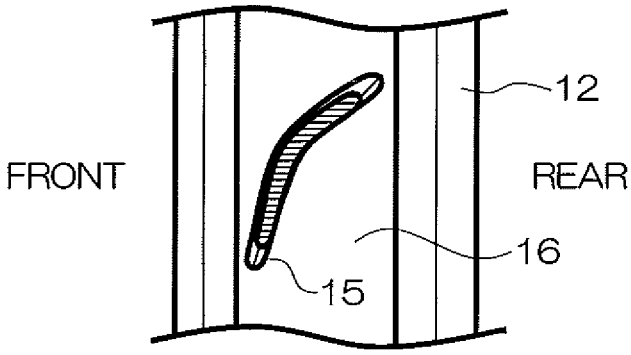
FIG. 8B is a sectional view of the blade taken along line VIII-VIII in FIG. 4.

FIG. 7A and FIG. 7B are sectional views of the propulsion unit 5. FIG. 8A and FIG. 8B are sectional views of the blade 15 taken along line VIII-VIII in FIG. 4.

As shown in FIG. 7A, the inner diameter of the front end of the duct 12 may be equal to the inner diameter of the rear end of the duct 12. In this case, as shown in FIG. 8A, the cross section of the blade 15 may be linear. According to this arrangement, if the rotation speed of the propeller 6 is the same, the propulsion unit 5 can generate a thrust force in the backward direction that is substantially the same in strength as a thrust force in the forward direction.

On the other hand, as shown in FIG. 7B, the inner diameter IDf of the front end of the duct 12 may be greater than the inner diameter IDr of the rear end of the duct 12. In this case, as shown in FIG. 8B, the cross section of the blade 15 may have a circular-arc shape that is forwardly convex. According to this arrangement, the flow passage area of the rear end of the duct 12 is smaller than the flow passage area of the front end of the duct 12, and therefore a water stream that flows through the duct 12 from the front toward the rear is accelerated by the duct 12. As a result, an even greater thrust force in the forward direction is generated. Additionally, propulsive efficiency is improved because the cross section of the blade 15 includes a circular-arc shape.

As described above, in the first preferred embodiment, the blades 15 of the propeller 6 are surrounded by the rim 16 of the propeller 6. The rim 16 is surrounded by the duct 12. The duct 12 holds the propeller 6. The duct 12 is rotatable around the steering axis A1 together with the steering shaft 4. When the steering shaft 4 is steered around the steering axis A1, the propeller 6 rotates around the steering axis A1 together with the duct 12. The rim 16 is rotatable around the propeller axis A2 together with the blades 15 with respect to the duct 12. Therefore, when the electric motor 7 rotates the rim 16 with respect to the duct 12, the blades 15 rotate around the propeller axis A2 with respect to the duct 12. As a result, a water stream is created, and the marine vessel V1 is propelled.

The electric motor 7 is disposed outside of the blades 15 with respect to the propeller axis A2. Therefore, the effective area of the propeller 6 is wider, and the propulsive efficiency is higher than in an arrangement in which the electric motor 7 is disposed in front of or behind the propeller 6. Additionally, the length in the front-rear direction of an underwater portion of the marine vessel propulsion device 1 disposed in the water is smaller, and therefore a resistance that the underwater portion receives from the water during steering is smaller than in an arrangement in which the electric motor 7 is disposed in front of or behind the propeller 6. Therefore, a steering load can be reduced, and a high-output motor can be achieved with the electric motor 7. Still additionally, the entire electric motor 7 is disposed in the water, and therefore it is difficult for a motor sound to travel to persons on the marine vessel. Therefore, the quietness of the marine vessel propulsion device 1 can be improved.

Additionally, the propulsive efficiency becomes higher than a conventional marine vessel propulsion device in which an electric motor is disposed in front of or behind a propeller, and therefore the power consumption of the electric motor 7 can be reduced. Still additionally, the entire electric motor 7 is disposed in the water, and therefore the electric motor 7 can be prevented from increasing in temperature compared to a case in which the electric motor 7 is disposed in the air. Therefore, the electric motor 7 can be prevented from undergoing a rise in electric resistance resulting from a rise in temperature. Therefore, the power consumption of the electric motor 7 can be made even smaller. As a result, it is possible to increase the operating time of the marine vessel propulsion device 1 and to increase the sailing distance of the marine vessel V1. Alternatively, the capacity of the battery 9 can be reduced without decreasing the operating time of the marine vessel propulsion device 1 and without decreasing the sailing distance of the marine vessel V1. As a result, the weight of the marine vessel V1 can be reduced.

Next, a second preferred embodiment of the present invention will be described.

A main difference between the second preferred embodiment and the first preferred embodiment is that a rotational shaft is disposed in the center of the propeller.

Figure 9:
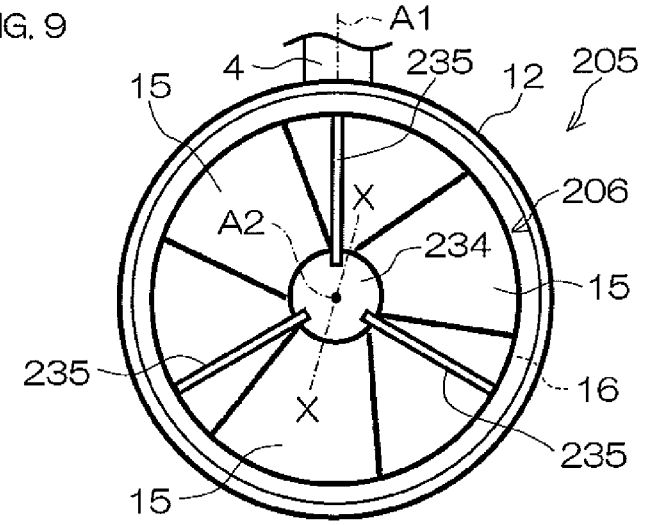
FIG. 9 is a rear view of a propulsion unit according to a second preferred embodiment of the present invention.
Figure 10A:
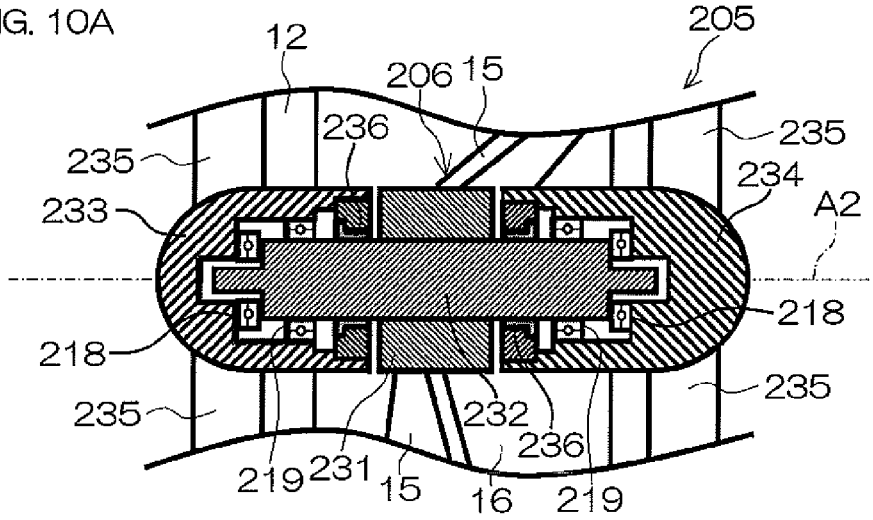
FIG. 10A is a sectional view of the propulsion unit taken along line X-X in FIG. 9.
Figure 10B:
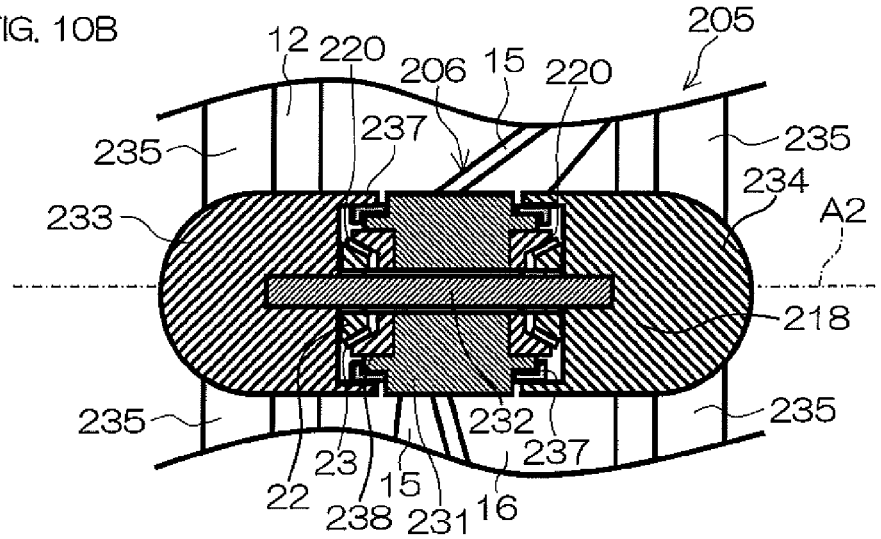
FIG. 10B is a sectional view of the propulsion unit taken along line X-X in FIG. 9.

FIG. 9 is a rear view of a propulsion unit 205 according to the second preferred embodiment of the present invention. FIG. 10A and FIG. 10B are sectional views of the propulsion unit 205 taken along line X-X in FIG. 9. In FIG. 9 to FIG. 10B, the same reference numerals as in FIGS. 1 to 8B are given to the components corresponding to the components shown in FIGS. 1 to 8B, and a description of these components is omitted.

The propulsion unit 205 according to the second preferred embodiment preferably has the same arrangement as the propulsion unit 5 according to the first preferred embodiment exclusive of the propeller 6. In other words, the propulsion unit 205 includes a propeller 206 instead of the propeller 6 according to the first preferred embodiment.

As shown in FIG. 9, the propeller 206 is held by the duct 12. The propeller 206 and the duct 12 are disposed coaxially. The propeller 206 includes the plurality of blades 15 and the rim 16. The blades 15 are spaced apart in the circumferential direction of the propeller 206 in the same manner as in the first preferred embodiment. The blades 15 extend radially from the propeller axis A2 outwardly in the radial direction of the rim 16. The rim 16 surrounds an outer end (in the radial direction) of each of the blades 15. As shown in FIG. 10A and FIG. 10B, the propeller 206 additionally includes a cylindrical rotational shaft 231 that extends in the front-rear direction along the propeller axis A2 and a center shaft 232 that penetrates the rotational shaft 231 in the front-rear direction. Inner ends (i.e., ends on the side opposite to the rim 16) of the blades 15 are fixed to the rotational shaft 231. The rotational shaft 231 is connected to the center shaft 232 rotatably together therewith. The rotational shaft 231 rotates around the propeller axis A2 together with the center shaft 232. Therefore, the rotational shaft 231 is rotatable around the propeller axis A2 together with the blades 15, the rim 16, and the center shaft 232. The center shaft 232 extends in the front-rear direction along the propeller axis A2. The front end and the rear end of the center shaft 232 protrude from the rotational shaft 231.

As shown in FIG. 10A and FIG. 10B, the propulsion unit 205 additionally includes a front fixed shaft 233 and a rear fixed shaft 234 that support the front end and the rear end of the center shaft 232, respectively, through a plurality of bearings and a plurality of fixed blades 235 that connect the front and rear fixed shafts 233 and 234 to the duct 12. The propeller 206 is held by the duct 12 rotatably around the propeller axis A2 through the front fixed shaft 233, the rear fixed shaft 234, and the fixed blades 235. Therefore, the rim 16 may be held by the duct 12 through the bearings 18, 19, and 20 shown in FIG. 5A and FIG. 5B, or may not be held by the duct 12 through the bearings 18, 19, and 20.

The front fixed shaft 233 and the rear fixed shaft 234 extend in the front-rear direction along the propeller axis A2. Each of the front and rear fixed shafts 233 and 234 preferably has a cylindrical or substantially cylindrical shape having an outer diameter roughly equal to that of the rotational shaft 231. The front end of the front fixed shaft 233 is a forwardly convex hemisphere, and the rear end of the rear fixed shaft 234 is a rearwardly convex hemisphere. The fixed blades 235 extend from the front fixed shaft 233 or from the rear fixed shaft 234 outwardly in the radial direction. The fixed blades 235 may be a flat plate extending in the radial direction, or may be a curved plate having a curved portion. As shown in FIG. 9, the outer ends of the fixed blades 235 are fixed to the duct 12, and the inner ends of the fixed blades 235 are fixed to the front fixed shaft 233 or to the rear fixed shaft 234. Therefore, the front fixed shaft 233 and the rear fixed shaft 234 are fixed to the duct 12, and are non-rotatable with respect to the duct 12.

As shown in FIG. 10A and FIG. 10B, the front end and the rear end of the center shaft 232 are disposed inside the front fixed shaft 233 and inside the rear fixed shaft 234, respectively. As shown in FIG. 10A, the center shaft 232 may be supported by the front fixed shaft 233 and by the rear fixed shaft 234 through two thrust bearings 218 and two radial bearings 219. Alternatively, as shown in FIG. 10B, the center shaft 232 may be supported by the front fixed shaft 233 and by the rear fixed shaft 234 through two tapered roller bearings 220.

As shown in FIG. 10A, the thrust bearing 218 and the radial bearing 219 are disposed inside the front fixed shaft 233 or inside the rear fixed shaft 234. The inside of the front fixed shaft 233 and the inside of the rear fixed shaft 234 are filled with a lubricant such as lubricating oil. The space between the center shaft 232 and the front and rear fixed shafts 233 and 234 is sealed with annular seals 236 held by the front fixed shaft 233 or by the rear fixed shaft 234. The front seal 236 is disposed behind the front thrust bearing 218 and the front radial bearing 219, whereas the rear seal 236 is disposed in front of the rear thrust bearing 218 and the rear radial bearing 219. The front thrust bearing 218 and the front radial bearing 219 are disposed between the front end of the center shaft 232 and the front fixed shaft 233, whereas the rear thrust bearing 218 and the rear radial bearing 219 are disposed between the rear end of the center shaft 232 and the rear fixed shaft 234.

As shown in FIG. 10A, the two thrust bearings 218 are disposed in front of and behind the center shaft 232, respectively, whereas the two radial bearings 219 surround the center shaft 232 around the propeller axis A2. The two thrust bearings 218 support the center shaft 232 rotatably around the propeller axis A2, and restrict an amount of movement in the axial direction of the center shaft 232. The two radial bearings 219 support the center shaft 232 rotatably around the propeller axis A2, and restrict an amount of movement in the radial direction of the center shaft 232. Therefore, the amount of movement in the axial and radial directions of the propeller 206 are restricted by the thrust bearings 218 and the radial bearings 219.

On the other hand, as shown in FIG. 10B, the two tapered roller bearings 220 are disposed inside the front fixed shaft 233 and inside the rear fixed shaft 234, respectively. The inside of the front fixed shaft 233 and the inside of the rear fixed shaft 234 are filled with a lubricant. The space between the center shaft 232 and the front and rear fixed shafts 233 and 234 is sealed with annular seals 237 held by the center shaft 232. The front seal 237 is disposed behind the front tapered roller bearing 220, whereas the rear seal 237 is disposed in front of the rear tapered roller bearing 220. The front tapered roller bearing 220 surrounds the center shaft 232 inside the front fixed shaft 233, whereas the rear tapered roller bearing 220 surrounds the center shaft 232 inside the rear fixed shaft 234. Additionally, the front tapered roller bearing 220 is disposed between the front fixed shaft 233 and the rotational shaft 231 with respect to the axial direction, whereas the rear tapered roller bearing 220 is disposed between the rear fixed shaft 234 and the rotational shaft 231 with respect to the axial direction.

As shown in FIG. 10B, the tapered roller bearing 20 includes the inner ring 22 that surrounds the center shaft 232, the plurality of rollers 23 disposed around the inner ring 22, and an outer ring 238 disposed around the rollers 23. The outer ring 238 is held by the center shaft 232. The outer ring 238 rotates around the propeller axis A2 together with the center shaft 232. Each roller 23 is in contact with the outer ring 238. The tapered roller bearings 220 support the center shaft 232 rotatably around the propeller axis A2, and restrict the amount of movement in the axial and radial directions of the center shaft 232. Therefore, the amount of movement in the axial and radial directions of the propeller 206 are restricted by the tapered roller bearings 220.

In the propulsion unit 205, when the propeller 206 rotates in the normal rotation direction, water is sucked from the front into the duct 12, and the water sucked into the duct 12 is sent rearwardly from the propeller 206. The water sent rearwardly from the propeller 206 is allowed to flow through the space between the fixed blades 235 disposed behind the propeller 206, and then is discharged rearwardly from the duct 12. The torsion of a water stream caused by the rotation of the propeller 6 is reduced by allowing the water stream to flow through the space between the fixed blades 235, and the water stream is regularized. Likewise, in a case in which the propeller 206 rotates in the reverse rotation direction, the torsion of a water stream is reduced by allowing the water stream to flow through the space between the fixed blades 235 disposed in front of the propeller 206. Water flowing through the inside of the duct 12 is regularized by the fixed blades 235 in this way. In other words, the blades 15 function as moving blades, and the fixed blades 235 function as stationary blades.

Next, a third preferred embodiment of the present invention will be described.

A main difference between the third preferred embodiment and the first preferred embodiment is that the power of the electric motor is transmitted to the rim through a gear transmission mechanism.

Figure 11:
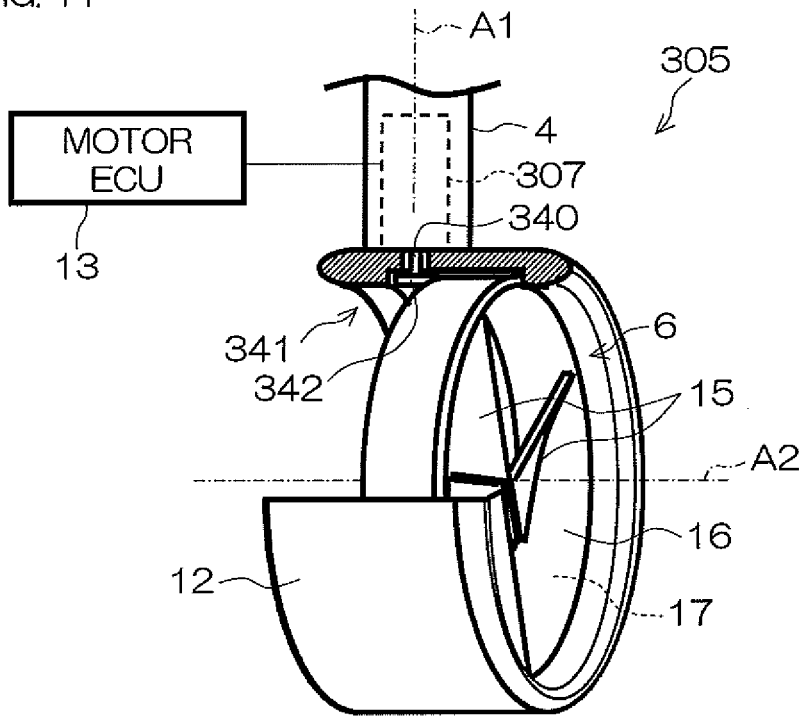
FIG. 11 is a partial sectional view of a propulsion unit according to a third preferred embodiment of the present invention.
Figure 12:
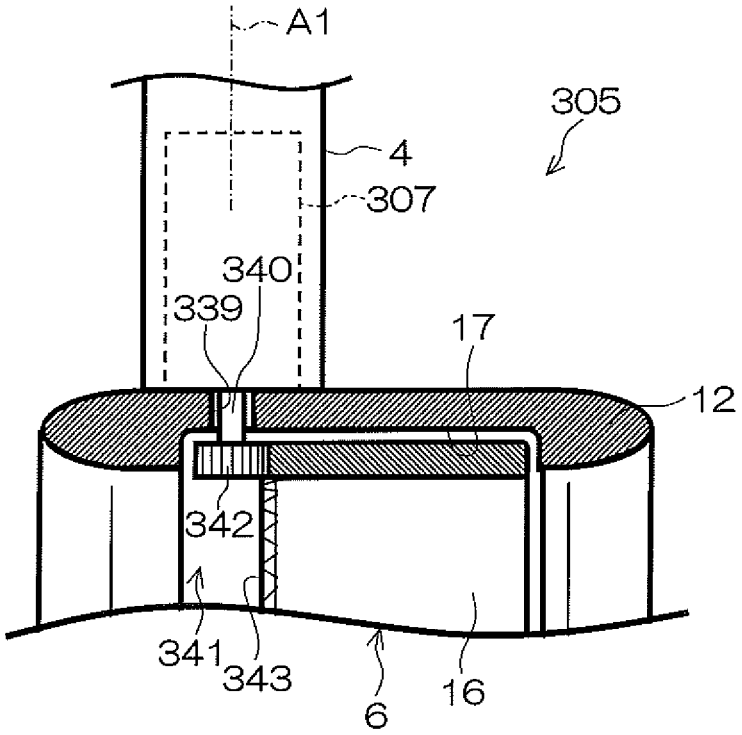
FIG. 12 is a sectional view of an outer peripheral portion of the propulsion unit according to the third preferred embodiment of the present invention.

FIG. 11 is a partial sectional view of a propulsion unit 305 according to the third preferred embodiment of the present invention. FIG. 12 is a sectional view of an outer peripheral portion of the propulsion unit 305 according to the third preferred embodiment of the present invention. In FIG. 11 and FIG. 12, the same reference numerals as in FIGS. 1 to 10B are given to the components corresponding to the components shown in FIGS. 1 to 10B, and a description of these components is omitted.

The propulsion unit 305 according to the third preferred embodiment preferably has the same arrangement as the propulsion unit 5 according to the first preferred embodiment exclusive of the electric motor 7. In other words, the propulsion unit 305 includes an electric motor 307 disposed inside the steering shaft 4 instead of the electric motor 7 according to the first preferred embodiment. The electric motor 307 is disposed above the duct 12. The electric motor 307 is controlled by the motor ECU 13. As shown in FIG. 12, the electric motor 307 includes a motor shaft 340 inserted in a through-hole 339 that passes through the duct 12 in the radial direction. The forward end of the motor shaft 340 is disposed in the annular groove 17.

The propulsion unit 305 additionally includes a gear transmission mechanism 341 that transmits the power of the electric motor 307 to the rim 16. The gear transmission mechanism 341 is disposed so as not to coincide with the blades 15 of the propeller 6 when seen from either of the front and rear sides along the propeller axis A2. In other words, the gear transmission mechanism 341 is positioned outside the outermost edge of the blades 15. The gear transmission mechanism 341 includes a driving gear 342 connected to the motor shaft 340 and a driven gear 343 provided on the front end surface of the rim 16. The driving gear 342 is a spur gear or a helical gear, whereas the driven gear 343 is a surface gear. The driving gear 342 and the driven gear 343 may mesh with each other, or may mesh with a shared intermediate gear. FIG. 11 and FIG. 12 show a state in which the driving gear 342 meshes with the driven gear 343. The driving gear 342 rotates together with the motor shaft 340, whereas the driven gear 343 rotates together with the rim 16. The rotation of the electric motor 307 is transmitted to the rim 16 while being decelerated by the gear transmission mechanism 341. As a result, the power of the electric motor 307 is transmitted to the rim 16 in an amplified state, and the propeller 6 rotates around the propeller axis A2 with respect to the duct 12.

Next, a fourth preferred embodiment of the present invention will be described.

A main difference between the fourth preferred embodiment and the first preferred embodiment is that the propeller includes contra-rotating propellers.

Figure 13:
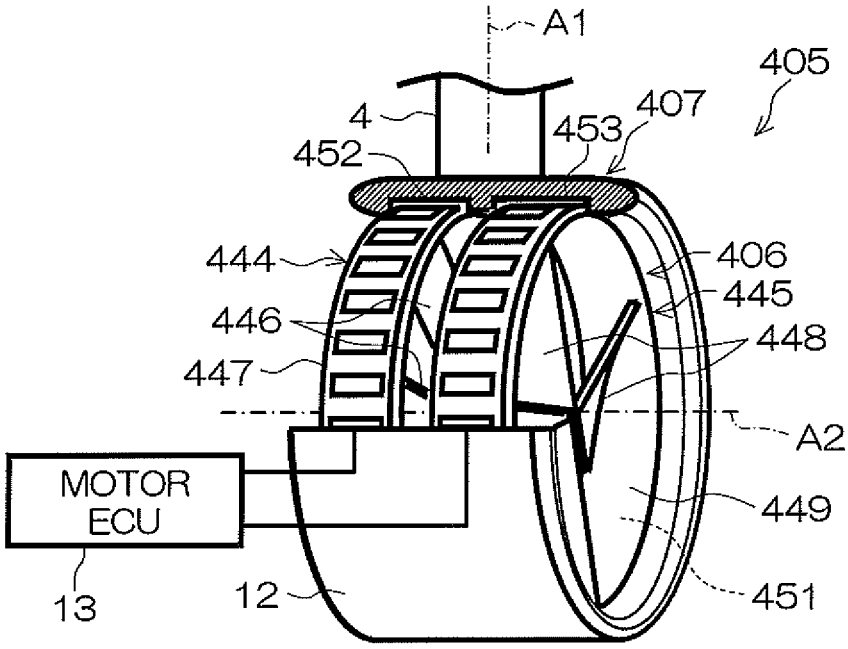
FIG. 13 is a partial sectional view of a propulsion unit according to a fourth preferred embodiment of the present invention.
Figure 14:
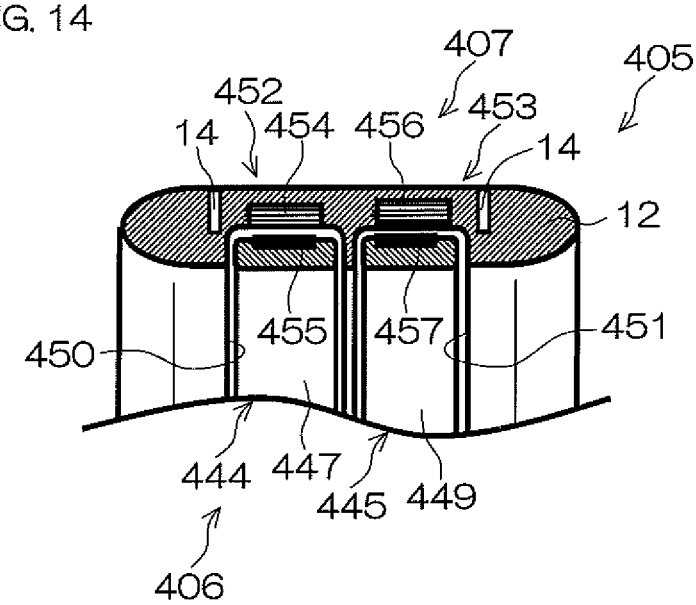
FIG. 14 is a sectional view of an outer peripheral portion of the propulsion unit according to the fourth preferred embodiment of the present invention.

FIG. 13 is a partial sectional view of a propulsion unit 405 according to the fourth preferred embodiment of the present invention. FIG. 14 is a sectional view of an outer peripheral portion of the propulsion unit 405 according to the fourth preferred embodiment of the present invention. In FIG. 13 and FIG. 14, the same reference numerals as in FIGS. 1 to 12 are given to the components corresponding to the components shown in FIGS. 1 to 12, and a description of these components is omitted.

The propulsion unit 405 according to the fourth preferred embodiment includes a propeller 406 that generates a thrust force and an electric motor 407 that rotates the propeller 406 around the propeller axis A2. The propulsion unit 405 additionally includes the cylindrical duct 12 that surrounds the propeller 406 around the propeller axis A2, the motor ECU 13 that controls the electric motor 407, and the motor rotation angle detector 14 that detects the rotation angle of the electric motor 407. The propeller 406 is held by the duct 12. The propeller 406 and the duct 12 are disposed coaxially.

As shown in FIG. 13, the propeller 406 includes a front propeller 444 and a rear propeller 445 disposed at the front and rear sides, respectively. The front propeller 444 and the rear propeller 445 are coaxial with the duct 12. The front propeller 444 and the rear propeller 445 are held by the duct 12 rotatably around a shared axis (i.e., propeller axis A2). The front propeller 444 and the rear propeller 445 define contra-rotating propellers. In other words, the front propeller 444 generates a thrust force in the forward direction by rotating in the normal rotation direction, and generates a thrust force in the backward direction by rotating in the reverse rotation direction. On the other hand, the rear propeller 445 generates a thrust force in the forward direction by rotating in the reverse rotation direction, and generates a thrust force in the backward direction by rotating in the normal rotation direction.

As shown in FIG. 13, the front propeller 444 includes a plurality of front blades 446 rotatable around the propeller axis A2 and a cylindrical front rim 447 that surrounds the front blades 446 and that is rotatable around the propeller axis A2 together with the front blades 446. Likewise, the rear propeller 445 includes a plurality of rear blades 448 rotatable around propeller axis A2 and a cylindrical rear rim 449 that surrounds the rear blades 448 and that is rotatable around the propeller axis A2 together with the rear blades 448.

The front rim 447 and the rear rim 449 are disposed at the front and rear sides, respectively, along the propeller axis A2. The front rim 447 and the rear rim 449 preferably have the same shape as each other. In other words, the outer diameter of the front rim 447 is equal to the outer diameter of the rear rim 449, and the inner diameter of the front rim 447 is equal to the inner diameter of the rear rim 449. Additionally, the shaft length (i.e., length in the front-rear direction) of the front rim 447 is preferably equal to the shaft length of the rear rim 449.

As shown in FIG. 13, the front blades 446 are spaced apart in the circumferential direction of the propeller 406. The front blades 446 extend radially from the propeller axis A2 outwardly in the radial direction of the front rim 447. The front rim 447 surrounds an outer end (in the radial direction) of each of the front blades 446. Each front blade 446 has a substantially triangular shape that extends from an inner peripheral surface of the front rim 447 toward the propeller axis A2. The outer end of each front blade 446 is fixed to the front rim 447. Therefore, the front blades 446 and the front rim 447 are rotatable together around the propeller axis A2. The front rim 447 surrounds the propeller axis A2 inside the duct 12. The central axis of the front rim 447 and that of the duct 12 are disposed on the propeller axis A2.

As shown in FIG. 14, the front rim 447 is contained in a front annular groove 450 provided in the inner peripheral portion of the duct 12. The front annular groove 450 is recessed from the inner peripheral surface of the duct 12, and is continuous over its whole circumference. The front rim 447 is rotatable around the propeller axis A2 with respect to the duct 12 in a state of being contained in the front annular groove 450. Therefore, the front propeller 444 is rotatable around the propeller axis A2 with respect to the duct 12.

On the other hand, as shown in FIG. 13, the rear blades 448 are spaced apart in the circumferential direction of the propeller 406. The rear blades 448 extend radially from the propeller axis A2 outwardly in the radial direction of the rear rim 449. The rear rim 449 surrounds an outer end (in the radial direction) of each of the rear blades 448. Each rear blade 448 has a substantially triangular shape that extends from an inner peripheral surface of the rear rim 449 toward the propeller axis A2. The outer end of each rear blade 448 is fixed to the rear rim 449. Therefore, the rear blades 448 and the rear rim 449 are rotatable together around the propeller axis A2. The rear rim 449 surrounds the propeller axis A2 inside the duct 12. The central axis of the rear rim 449 and that of the duct 12 are disposed on the propeller axis A2.

As shown in FIG. 14, the rear rim 449 is contained in a rear annular groove 451 provided in the inner peripheral portion of the duct 12. The rear annular groove 451 is recessed from the inner peripheral surface of the duct 12, and is continuous over its whole circumference. The rear rim 449 is rotatable around the propeller axis A2 with respect to the duct 12 in a state of being contained in the rear annular groove 451. Therefore, the rear propeller 445 is rotatable around the propeller axis A2 with respect to the duct 12.

As shown in FIG. 14, the electric motor 407 includes a front electric motor 452 that rotates the front rim 447 around the propeller axis A2 and a rear electric motor 453 that rotates the rear rim 449 around the propeller axis A2. The front electric motor 452 and the rear electric motor 453 are controlled by the motor ECU 13. The front electric motor 452 and the rear electric motor 453 may be the same type of motors, or may be different type of motors.

As shown in FIG. 14, the front electric motor 452 includes an annular front stator 454 defined by a portion of the duct 12 and a cylindrical front rotor 455 defined by a portion of the front rim 447. In other words, the duct 12 includes the front stator 454 disposed between the outer peripheral surface of the duct 12 and the bottom surface of the front annular groove 450, and the front rim 447 includes the front rotor 455 disposed at the outer peripheral portion of the front rim 447. The front stator 454 and the front rotor 455 surround the propeller axis A2. The front stator 454 and the front rotor 455 face each other with a space therebetween in the radial direction of the propeller 406. The rotation angle of the front rotor 455 with respect to the front stator 454 is detected by the motor rotation angle detector 14.

Likewise, as shown in FIG. 14, the rear electric motor 453 includes an annular rear stator 456 defined by a portion of the duct 12 and a cylindrical rear rotor 457 defined by a portion of the rear rim 449. In other words, the duct 12 includes the rear stator 456 disposed between the outer peripheral surface of the duct 12 and the bottom surface of the rear annular groove 451, and the rear rim 449 includes the rear rotor 457 disposed at the outer peripheral portion of the rear rim 449. The rear stator 456 and the rear rotor 457 surround the propeller axis A2. The rear stator 456 and the rear rotor 457 face each other with a space therebetween in the radial direction of the propeller 406. The rotation angle of the rear rotor 457 with respect to the rear stator 456 is detected by the motor rotation angle detector 14.

The front electric motor 452 rotates the front blades 446 around the propeller axis A2 by rotating the front rim 447 around the propeller axis A2 with respect to the duct 12. Likewise, the rear electric motor 453 rotates the rear blades 448 around the propeller axis A2 by rotating the rear rim 449 around the propeller axis A2 with respect to the duct 12. The motor ECU 13 rotates the front propeller 444 in the normal rotation direction, and rotates the rear propeller 445 in the reverse rotation direction at the same rotation speed as the front propeller 444 by controlling the front electric motor 452 and the rear electric motor 453. As a result, a thrust force in the forward direction is generated. Likewise, the motor ECU 13 rotates the front propeller 444 in the reverse rotation direction, and rotates the rear propeller 445 in the normal rotation direction at the same rotation speed as the front propeller 444 by controlling the front electric motor 452 and the rear electric motor 453. As a result, a thrust force in the backward direction is generated.

Next, a fifth preferred embodiment of the present invention will be described.

A main difference between the fifth preferred embodiment and the fourth preferred embodiment is that the power of the electric motor is transmitted to the rim through a gear transmission mechanism.

Figure 15:
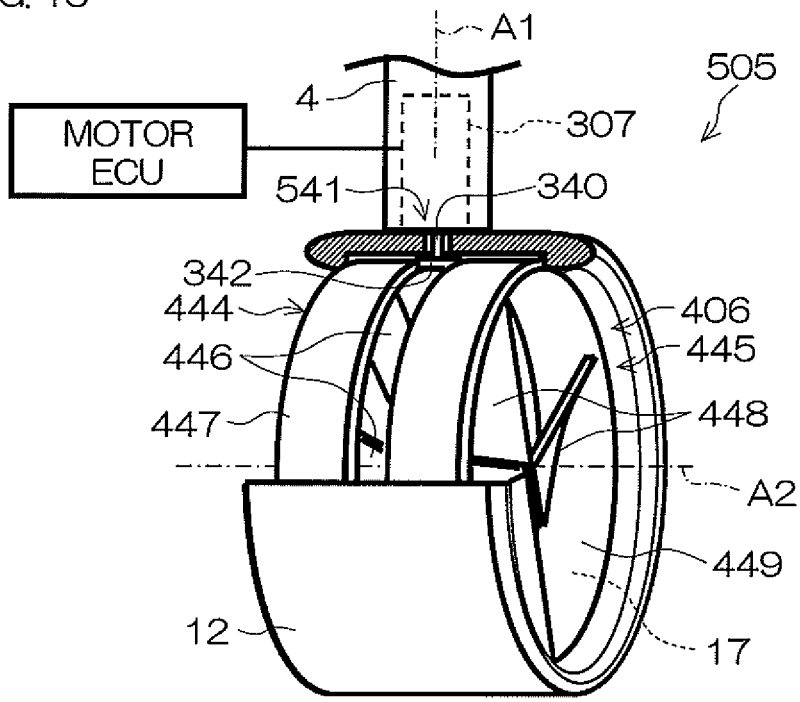
FIG. 15 is a partial sectional view of a propulsion unit according to a fifth preferred embodiment of the present invention.
Figure 16:
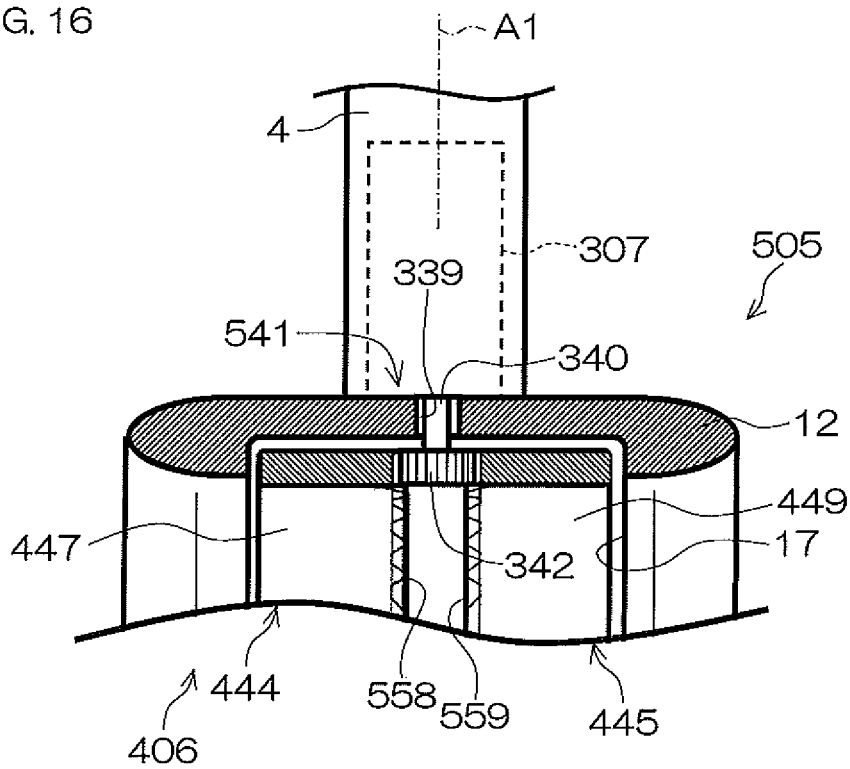
FIG. 16 is a sectional view of an outer peripheral portion of the propulsion unit according to the fifth preferred embodiment of the present invention.

FIG. 15 is a partial sectional view of a propulsion unit 505 according to the fifth preferred embodiment of the present invention. FIG. 16 is a sectional view of an outer peripheral portion of the propulsion unit 505 according to the fifth preferred embodiment of the present invention. In FIG. 15 and FIG. 16, the same reference numerals as in FIGS. 1 to 14 are given to the components corresponding to the components shown in FIGS. 1 to 14, and a description of these components is omitted.

The propulsion unit 505 according to the fifth preferred embodiment preferably has the same arrangement as the propulsion unit 405 according to the fourth preferred embodiment exclusive of the electric motor 407. In other words, the propulsion unit 505 includes the electric motor 307 disposed inside the steering shaft 4 instead of the electric motor 407 according to the fourth preferred embodiment. The propulsion unit 505 additionally includes a gear transmission mechanism 541 that transmits the power of the electric motor 307 to the rim 16. The gear transmission mechanism 541 is disposed so as not to coincide with the blades 446 and 448 of the propeller 406 when seen from either of the front and rear sides along the propeller axis A2. In other words, the gear transmission mechanism 541 is positioned outside the outermost edge of each of the blades 446 and 448.

As shown in FIG. 16, the gear transmission mechanism 541 includes the driving gear 342 connected to the motor shaft 340 of the electric motor 307, a front driven gear 558 arranged on the rear end surface of the front rim 447, and a rear driven gear 559 arranged on the front end surface of the rear rim 449. The driving gear 342 is a spur gear or a helical gear, whereas the front driven gear 558 and the rear driven gear 559 are surface gears. The driving gear 342 and the front driven gear 558 may mesh with each other, or may mesh with a shared intermediate gear. The same applies to the driving gear 342 and the rear driven gear 559. In FIG. 15 and FIG. 16, the driving gear 342 is disposed between the front rim 447 and the rear rim 449, and FIG. 15 and FIG. 16 show a state in which the driving gear 342 meshes with both the front driven gear 558 and the rear driven gear 559.

The driving gear 342 rotates together with the motor shaft 340. The front driven gear 558 and the rear driven gear 559 rotate together with the front rim 447 and the rear rim 449, respectively. The reduction gear ratio between the driving gear 342 and the front driven gear 558 is equal to the reduction gear ratio between the driving gear 342 and the rear driven gear 559. Therefore, when the driving gear 342 rotates, the front rim 447 and the rear rim 449 rotate at the same rotation speed in mutually opposite directions. The rotation of the electric motor 307 is transmitted to the front rim 447 and to the rear rim 449 while being decelerated by the gear transmission mechanism 541. As a result, the power of the electric motor 307 is transmitted to the front rim 447 and to the rear rim 449 in an amplified state, and the front propeller 444 and the rear propeller 445 rotate in mutually opposite directions with respect to the duct 12.

Next, a sixth preferred embodiment of the present invention will be described.

A main difference between the sixth preferred embodiment and the fourth preferred embodiment is that a propeller pitch (i.e., a distance advanced by one rotation of the propeller) can be changed and that an outer peripheral side restricting portion is provided to restrict a relative rotation amount of the front rim and a relative rotation amount of the rear rim at an outer peripheral portion of the propeller.

Figure 17:
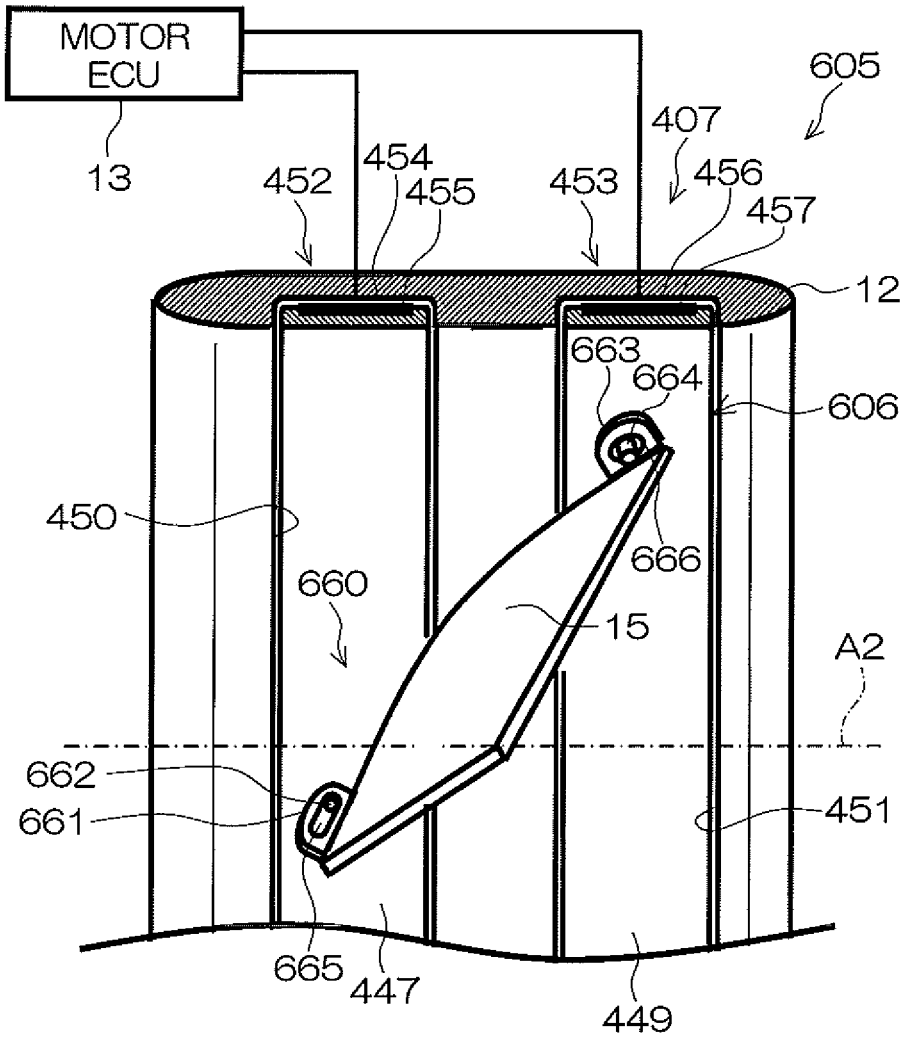
FIG. 17 is a sectional view of a propulsion unit according to a sixth preferred embodiment of the present invention.
Figure 18A:
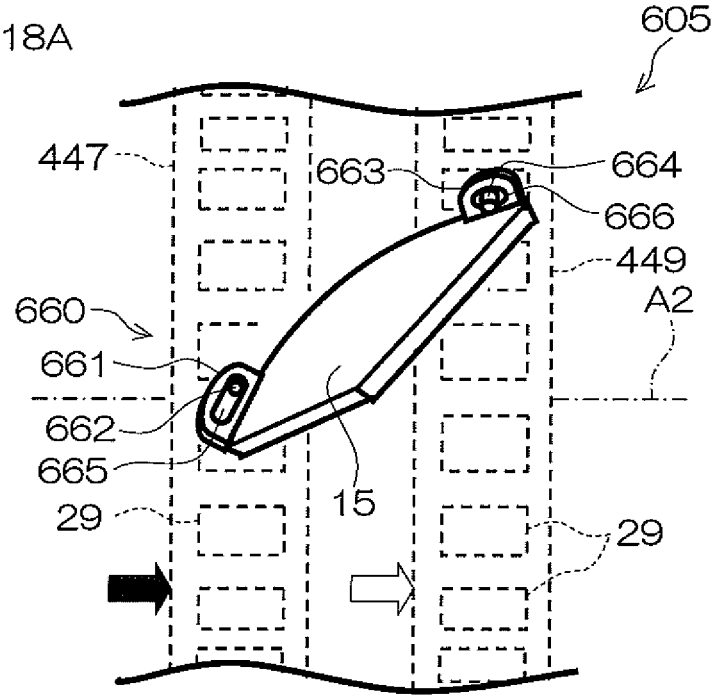
FIG. 18A is a view for describing the inclination angle of a blade with respect to a propeller axis.
Figure 18B:
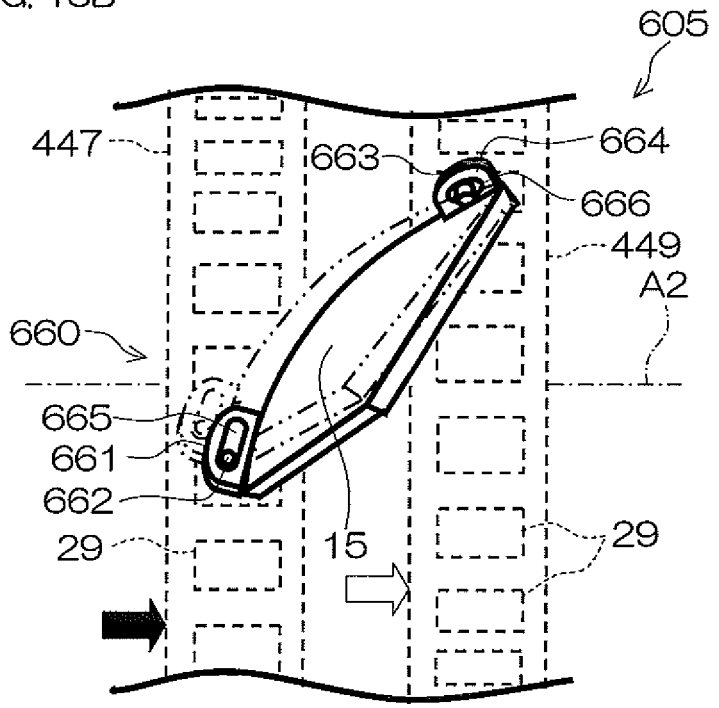
FIG. 18B is a view for describing the inclination angle of the blade with respect to the propeller axis.

FIG. 17 is a sectional view of a propulsion unit 605 according to the sixth preferred embodiment of the present invention. FIG. 18A and FIG. 18B are views for describing the inclination angle of the blade 15 with respect to the propeller axis A2. In FIG. 17 to FIG. 18B, the same reference numerals as in FIGS. 1 to 16 are given to the components corresponding to the components shown in FIGS. 1 to 16, and a description of these components is omitted.

The propulsion unit 605 according to the sixth preferred embodiment preferably has the same arrangement as the propulsion unit 405 according to the fourth preferred embodiment exclusive of the propeller 406. In other words, the propulsion unit 605 includes a propeller 606 instead of the propeller 406 according to the fourth preferred embodiment.

As shown in FIG. 17, the propeller 606 includes the plurality of blades 15 rotatable around the propeller axis A2, the cylindrical front rim 447 that surrounds the blades 15, and the rear rim 449 that surrounds the blades 15 behind the front rim 447. The blades 15 are spaced apart in the circumferential direction of the propeller 606. The blades 15 extend radially from the propeller axis A2 outwardly in the radial direction of the rims 447 and 449. The rims 447 and 449 surround an outer end (in the radial direction) of each of the blades 15. In FIG. 17 to FIG. 18B, only one of the blades 15 is shown in the figures, and the other blades 15 are omitted. Each blade 15 is supported by the front rim 447 and the rear rim 449. The front rim 447 and the rear rim 449 are held by the duct 12 so as to be relatively rotatable around the propeller axis A2.

As shown in FIG. 17, the propulsion unit 605 additionally includes an outer peripheral side restricting portion 660 that restricts a relative rotation amount of the front rim 447 and the rear rim 449 with respect to each other. The outer peripheral side restricting portion 660 includes a front supported portion 661 disposed at the front end of the blade 15 and a front supporting portion 662 disposed at the front rim 447. The outer peripheral side restricting portion 660 additionally includes a rear supported portion 663 disposed at the rear end of the blade 15 and a rear supporting portion 664 disposed at the rear rim 449. The front supporting portion 662 is disposed on the inner peripheral surface of the front rim 447, whereas the rear supporting portion 664 is disposed on the inner peripheral surface of the rear rim 449. The front supporting portion 662 is a rod-shaped projection that protrudes from the inner peripheral surface of the front rim 447, and the rear supporting portion 664 is a rod-shaped projection that protrudes from the inner peripheral surface of the rear rim 449. The front supporting portion 662 is inserted in a front insertion hole 665 defined by the front supported portion 661. Likewise, the rear supporting portion 664 is inserted in a rear insertion hole 666 defined by the rear supported portion 663.

As shown in FIG. 17, the front insertion hole 665 is a long hole extending in a direction (longitudinal direction) that inclines with respect to the propeller axis A2, and the rear insertion hole 666 is approximately circular. The front supported portion 661 is supported by the front supporting portion 662 rotatably around the front supporting portion 662. Likewise, the rear supported portion 663 is supported by the rear supporting portion 664 rotatably around the rear supporting portion 664. The front insertion hole 665 is a long hole, and therefore the front supported portion 661 is movable in the longitudinal direction of the front insertion hole 665 with respect to the front supporting portion 662. The movement amount of the front supported portion 661 with respect to the front supporting portion 662 is restricted by contact between the front supporting portion 662 and the front supported portion 661 (i.e., inner surface of the front insertion hole 665).

As shown by a black arrow and a white arrow in FIG. 18A and FIG. 18B, when the front rim 447 and the rear rim 449 relatively rotate around the propeller axis A2, the front supported portion 661 moves in the longitudinal direction of the front insertion hole 665 with respect to the front supporting portion 662. At this time, the rear supported portion 663 rotates around the rear supporting portion 664 with respect to the rear supporting portion 664. Therefore, the inclination angle of each blade 15 with respect to the propeller axis A2 changes. The amount of change of the inclination angle of the blade 15 rises in proportion to an increase in the relative rotation amount of the front rim 447 and the rear rim 449. When the relative rotation amount of the front rim 447 and the rear rim 449 reach a predetermined value, the inner surface of the front insertion hole 665 comes into contact with the front supporting portion 662, and the relative rotation of the front rim 447 and the rear rim 449 is restricted. As a result, the relative rotation amount of the front rim 447 and the rear rim 449 is restricted.

The front rim 447 is rotationally driven by the front electric motor 452 (see FIG. 17) around the propeller axis A2, whereas the rear rim 449 is rotationally driven by the rear electric motor 453 (see FIG. 17) around the propeller axis A2. As shown by the black and white arrows in FIG. 18A, the motor ECU 13 controls the front electric motor 452 and the rear electric motor 453, thereby rotating the front rim 447 and the rear rim 449 in a state in which the phase of the front rim 447 and that of the rear rim 449 coincide with each other (in the same phase state). Additionally, as shown by the black and white arrows in FIG. 18B, the motor ECU 13 controls the front electric motor 452 and the rear electric motor 453, thereby rotating the front rim 447 and the rear rim 449 in a state in which the phase of the front rim 447 is in a more forward position than the phase of the rear rim 449 (in a state in which the front rim 447 has advanced).

As shown in FIG. 18A, when the front rim 447 and the rear rim 449 rotate in a state in which the phase of the front rim 447 and that of the rear rim 449 coincide with each other, each blade 15 rotates around the propeller axis A2 together with the front and rear rims 447 and 449 in a state in which the front supporting portion 662 has been deviated rearwardly with respect to the front supported portion 661. Additionally, as shown in FIG. 18B, when the front rim 447 and the rear rim 449 rotate in a state in which the phase of the front rim 447 is in a more forward position than the phase of the rear rim 449, each blade 15 rotates around the propeller axis A2 together with the front and rear rims 447 and 449 in a state in which the front supporting portion 662 has been deviated forwardly with respect to the front supported portion 661.

As is understood from a comparison between FIG. 18A and FIG. 18B, a difference in the inclination angle of the blade 15 with respect to the propeller axis A2 exists between the state in which the phase of the front rim 447 and the phase of the rear rim 449 coincide with each other and the state in which the phase of the front rim 447 is in a more forward position than the phase of the rear rim 449. The pitch of the propeller 606 changes in accordance with the inclination angle of the blade 15 with respect to the propeller axis A2. Therefore, the motor ECU 13 can adjust the pitch of the propeller 606 within a range in which the front and rear rims 447 and 449 are relatively rotatable while controlling the phase of the front rim 447 and that of the rear rim 449. Therefore, the motor ECU 13 can change characteristics of the propeller 606 between a high torque type and a high output type.

Next, a seventh preferred embodiment of the present invention will be described.

A main difference between the seventh preferred embodiment and the fourth preferred embodiment is that the propeller pitch can be changed and that a center side restricting portion is provided to restrict the relative rotation amount of the front rim and the relative rotation amount of the rear rim in the center of the propeller.

Figure 19:
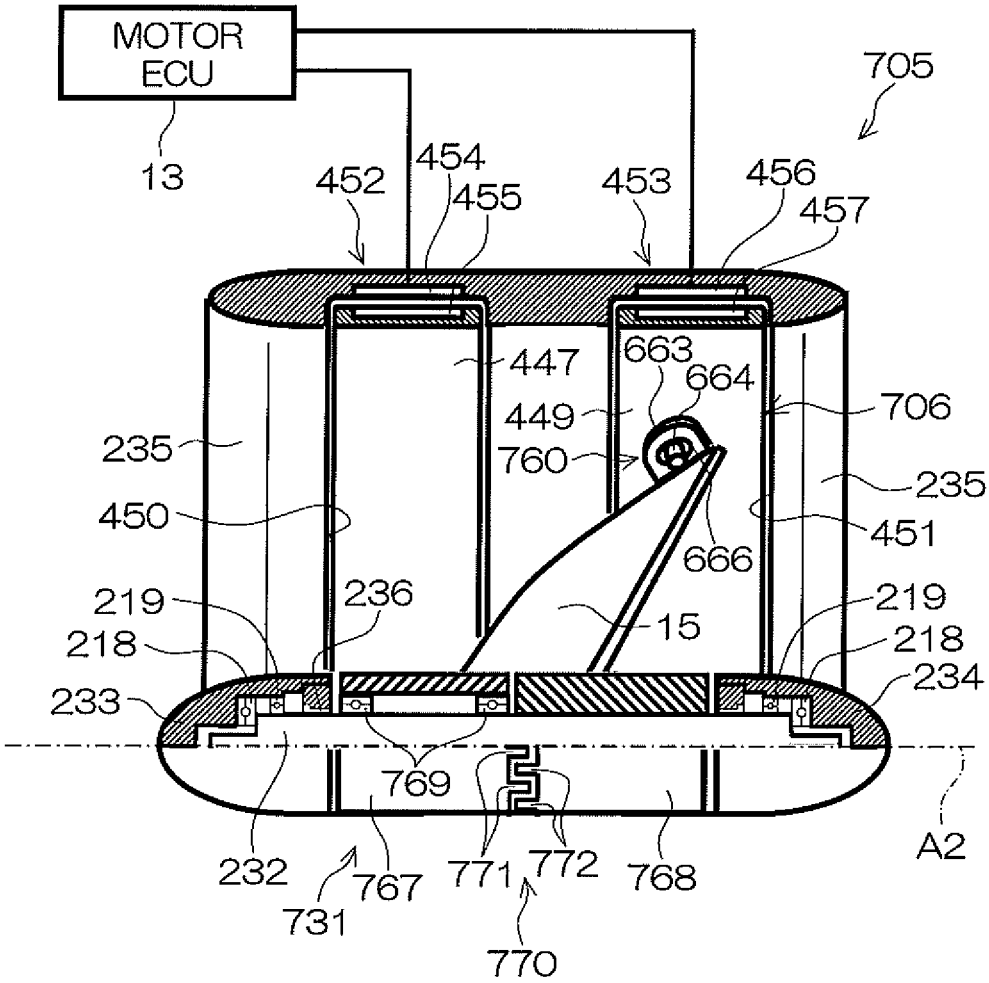
FIG. 19 is a sectional view of a propulsion unit according to a seventh preferred embodiment of the present invention.
Figure 20A:
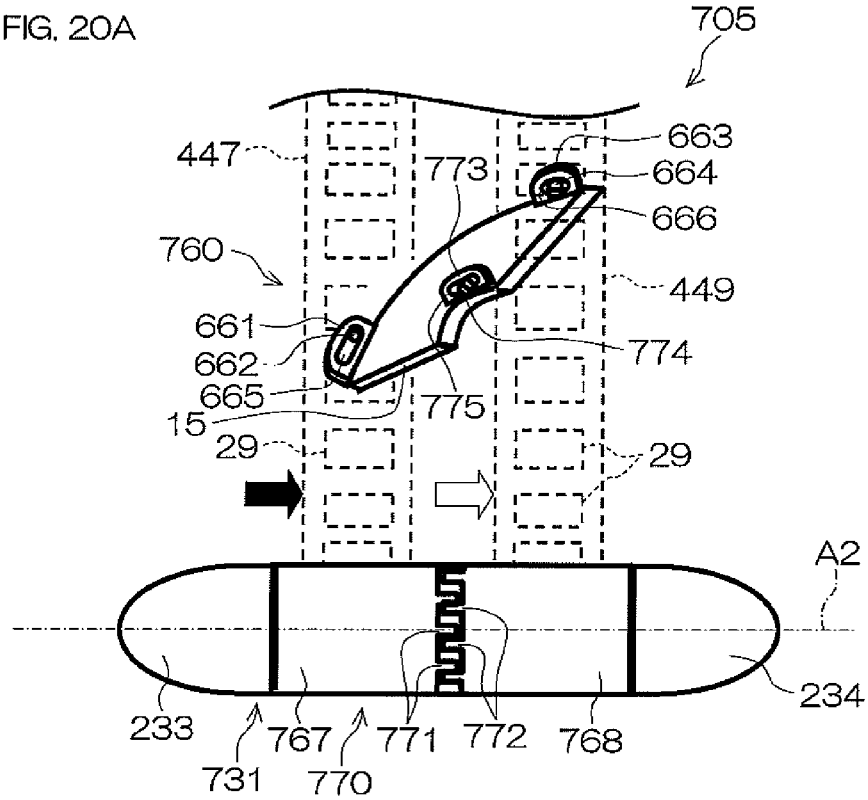
FIG. 20A is a view for describing the inclination angle of the blade with respect to the propeller axis.
Figure 20B:
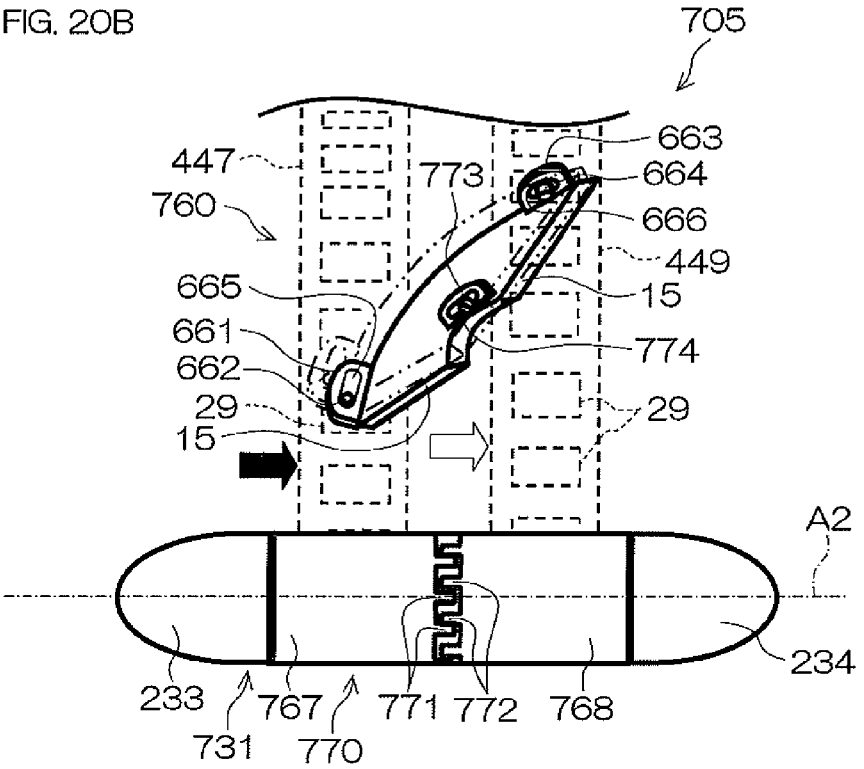
FIG. 20B is a view for describing the inclination angle of the blade with respect to the propeller axis.

FIG. 19 is a sectional view of a propulsion unit 705 according to the seventh preferred embodiment of the present invention. FIG. 20A and FIG. 20B are views for describing the inclination angle of the blade 15 with respect to the propeller axis A2. In FIG. 19 to FIG. 20B, the same reference numerals as in FIGS. 1 to 18B are given to the components corresponding to the components shown in FIGS. 1 to 18B, and a description of these components is omitted.

The propulsion unit 705 according to the seventh preferred embodiment preferably has the same arrangement as the propulsion unit 405 according to the fourth preferred embodiment exclusive of the propeller 406. In other words, the propulsion unit 705 includes a propeller 706 instead of the propeller 406 according to the fourth preferred embodiment.

As shown in FIG. 19, the propeller 706 includes the plurality of blades 15, the rims 447 and 449, and the center shaft 232. The blades 15 are spaced apart in the circumferential direction of the propeller 706. The blades 15 extend radially from the propeller axis A2 outwardly in the radial direction of the rims 447 and 449. The rims 447 and 449 surround an outer end (in the radial direction) of each of the blades 15. The propeller 706 additionally includes a cylindrical rotational shaft 731 that extends in the front-rear direction along the propeller axis A2. The center shaft 232 penetrates the rotational shaft 731 in the front-rear direction. The front end and the rear end of the center shaft 232 protrude from the rotational shaft 731. The propulsion unit 705 additionally includes the front fixed shaft 233 and the rear fixed shaft 234 that support the front end and the rear end of the center shaft 232, respectively, through the bearings 218 and 219 and the plurality of fixed blades 235 that connect the front and rear fixed shafts 233 and 234 to the duct 12.

As shown in FIG. 19, the rotational shaft 731 of the propeller 706 includes a cylindrical front rotational shaft 767 and a cylindrical rear rotational shaft 768 that extend in the front-rear direction along the propeller axis A2. The front rotational shaft 767 and the rear rotational shaft 768 are preferably equal in outer diameter to each other. The front rotational shaft 767 is supported by the center shaft 232 through the bearings 769 disposed between the front rotational shaft 767 and the center shaft 232. Therefore, the front rotational shaft 767 can relatively rotate around the propeller axis A2 with respect to the center shaft 232. The front rotational shaft 767 is fixed to the front rim 447 by a fixing member (not shown). The front rotational shaft 767 rotates around the propeller axis A2 together with the front rim 447. The rear rotational shaft 768 is disposed behind the front rotational shaft 767. The rear rotational shaft 768 is connected to the center shaft 232 rotatably together therewith. The rear rotational shaft 768 rotates around the propeller axis A2 together with the center shaft 232. Therefore, the rear rotational shaft 768 is relatively rotatable around the propeller axis A2 with respect to the front rotational shaft 767. As described below, the rear rotational shaft 768 is connected to the rear rim 449 through the blades 15. The rear rotational shaft 768 is rotatable around the propeller axis A2 together with the blades 15 and the rear rim 449.

As shown in FIG. 19, the propulsion unit 705 additionally includes a center side restricting portion 770 that restricts the relative rotation amount of the front rim 447 and the rear rim 449 by restricting the relative rotation amount of the front rotational shaft 767 and the rear rotational shaft 768. The propulsion unit 705 additionally includes an outer peripheral side restricting portion 760 that restricts the relative rotation amount of the front rim 447 and the rear rim 449. The relative rotation amount of the front rim 447 and the rear rim 449 that is allowed by the center side restricting portion 770 may be equal to or be different from the relative rotation amount of the front rim 447 and the rear rim 449 that is allowed by the outer peripheral side restricting portion 760. In other words, the relative rotation amount of the front rim 447 and the rear rim 449 may be restricted by both the center side restricting portion 770 and the outer peripheral side restricting portion 760, or may be restricted by either the center side restricting portion 770 or the outer peripheral side restricting portion 760.

As shown in FIG. 19, the center side restricting portion 770 includes a front engagement portion 771 and a rear engagement portion 772 that are disposed at the front rotational shaft 767 and the rear rotational shaft 768, respectively. The front engagement portion 771 is disposed at the rear end of the front rotational shaft 767, whereas the rear engagement portion 772 is disposed at the front end of the rear rotational shaft 768. The front engagement portion 771 includes a plurality of projections that protrude rearwardly, whereas the rear engagement portion 772 includes a plurality of projections that protrude forwardly. The front engagement portion 771 and the rear engagement portion 772 engage with each other. The front engagement portion 771 and the rear engagement portion 772 are relatively rotatable around the propeller axis A2 in a predetermined angular range. In other words, when the relative rotation amount of the front rotational shaft 767 and the rear rotational shaft 768 reach a predetermined value, the projections of the front engagement portion 771 and the projections of the rear engagement portion 772 come into contact with each other, and the relative rotation of the front rotational shaft 767 and the rear rotational shaft 768 is restricted.

On the other hand, as shown in FIG. 20A, the outer peripheral side restricting portion 760 includes the front supported portion 661, the front supporting portion 662, the rear supported portion 663, and the rear supporting portion 664. The outer peripheral side restricting portion 760 additionally includes an inner supported portion 773 disposed at the inner end of each blade 15 and an inner supporting portion 774 disposed at the rear rotational shaft 768. Although FIG. 20A shows a state in which the rear rotational shaft 768 and the inner supporting portion 774 are spaced apart from each other, the inner supporting portion 774 is preferably joined to the rear rotational shaft 768, and protrudes outwardly from the rear rotational shaft 768. The inner supporting portion 774 is a rod-shaped projection that protrudes from the outer peripheral surface of the rear rotational shaft 768. The inner supporting portion 774 is inserted in an inner insertion hole 775 defined by the inner supported portion 773.

As shown in FIG. 20A, the inner insertion hole 775 is a long hole extending in a direction (longitudinal direction) that inclines with respect to the propeller axis A2. The inner supported portion 773 is supported by the inner supporting portion 774 rotatably around the inner supporting portion 774. The inner insertion hole 775 is a long hole, and therefore the inner supported portion 773 is movable in the longitudinal direction of the inner insertion hole 775 with respect to the inner supporting portion 774. The movement amount of the inner supported portion 773 with respect to the inner supporting portion 774 is restricted by contact between the inner supporting portion 774 and the inner supported portion 773 (i.e., inner surface of the inner insertion hole 775).

As shown by the black and white arrows in FIG. 20A, the motor ECU 13 controls the front electric motor 452 and the rear electric motor 453, thereby rotating the front rim 447 and the rear rim 449 in a state in which the phase of the front rim 447 and that of the rear rim 449 coincide with each other. Additionally, as shown by the black and white arrows in FIG. 20B, the motor ECU 13 controls the front electric motor 452 and the rear electric motor 453, thereby rotating the front rim 447 and the rear rim 449 in a state in which the phase of the front rim 447 is in a more forward position than the phase of the rear rim 449.

As is understood from a comparison between FIG. 20A and FIG. 20B, a difference in the inclination angle of the blade 15 with respect to the propeller axis A2 exists between the state in which the phase of the front rim 447 and the phase of the rear rim 449 coincide with each other and the state in which the phase of the front rim 447 is in a more forward position than the phase of the rear rim 449. The pitch of the propeller 706 changes in accordance with the inclination angle of the blade 15 with respect to the propeller axis A2. Therefore, the motor ECU 13 can adjust the pitch of the propeller 706 within a range in which the front and rear rims 447 and 449 are relatively rotatable while controlling the phase of the front rim 447 and that of the rear rim 449. Therefore, the motor ECU 13 can change characteristics of the propeller 706 between a high torque type and a high output type.

Next, an eighth preferred embodiment of the present invention will be described.

A main difference between the eighth preferred embodiment and the first preferred embodiment is that a dust-proof structure is provided to prevent foreign substances from entering the space between the inner peripheral surface of the duct and the outer peripheral surface of the rim.

Figure 21A:
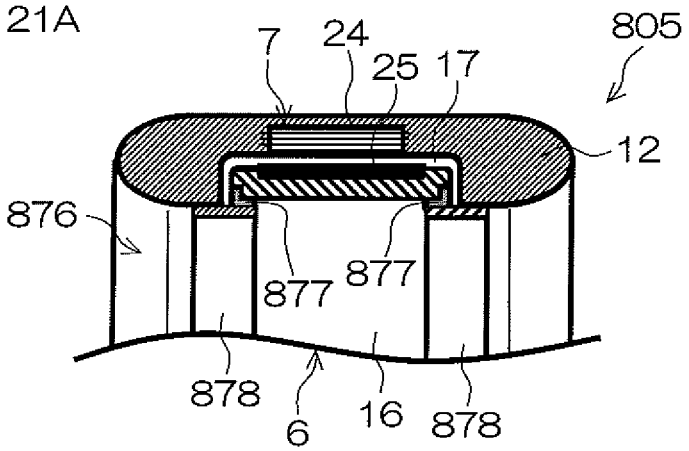
FIG. 21A is a sectional view of an outer peripheral portion of a propulsion unit according to an eighth preferred embodiment of the present invention.
Figure 21B:
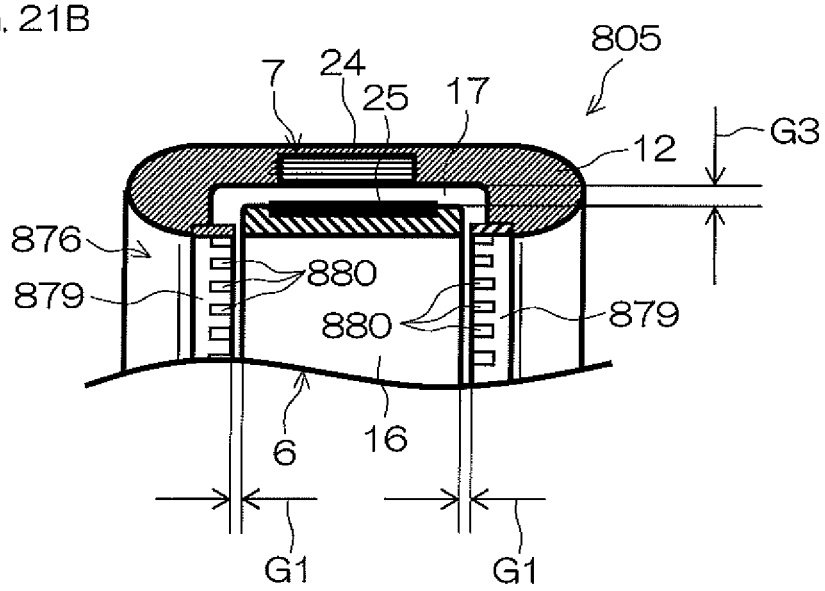
FIG. 21B is a sectional view of the outer peripheral portion of the propulsion unit according to the eighth preferred embodiment of the present invention.
Figure 22:
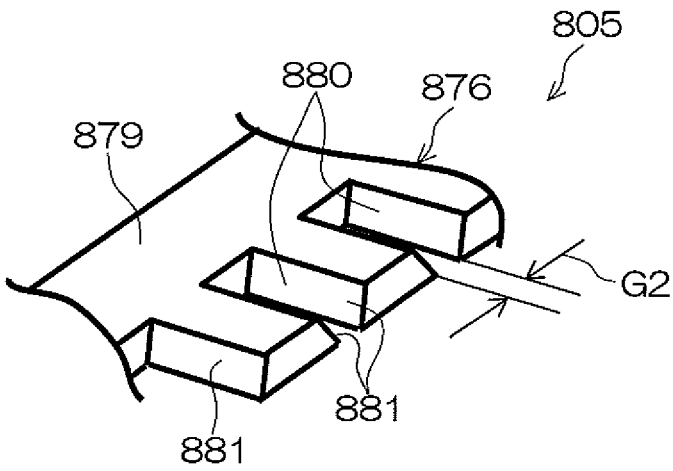
FIG. 22 is an enlarged perspective view of a portion of the propulsion unit shown in FIG. 21B.

FIG. 21A and FIG. 21B are sectional views of an outer peripheral portion of a propulsion unit 805 according to the eighth preferred embodiment of the present invention. FIG. 22 is an enlarged perspective view of a portion of the propulsion unit 805 shown in FIG. 21B. In FIG. 21A to FIG. 22, the same reference numerals as in FIGS. 1 to 20B are given to the components corresponding to the components shown in FIGS. 1 to 20B, and a description of these components is omitted.

The propulsion unit 805 according to the eighth preferred embodiment preferably includes the same arrangement as the propulsion unit 5 according to the first preferred embodiment. In other words, the propulsion unit 805 includes a dust-proof structure 876 that prevents foreign substances from entering the space between the inner peripheral surface of the duct 12 and the outer peripheral surface of the rim 16 in addition to the arrangement of the propulsion unit 5 according to the first preferred embodiment. The dust-proof structure 876 may be arranged to include a seal 877 shown in FIG. 21A, or may be arranged to include a dust-proof ring 879 shown in FIG. 21B.

In detail, the dust-proof structure 876 shown in FIG. 21A includes two pairs of seals 877 and securing rings 878 that are spaced apart in the front-rear direction. Each seal 877 has an annular shape that is continuous over its whole circumference. The front seal 877 is disposed at the front end of the rim 16, and the rear seal 877 is disposed at the rear end of the rim 16. The seal 877 is in contact with the rim 16 over its whole circumference. The seal 877 surrounds the securing ring 878 and serves as a pair of seals. The seal 877 is held by the securing ring 878 and serves as the pair of seals. The seal 877 is pressed against the rim 16 by the securing ring 878. As a result, the seal 877 is in close contact with the rim 16. The securing ring 878 extends from the inside of the seal 877 toward the inside of the duct 12. The securing ring 878 is fixed to the duct 12. Therefore, the seal 877 is fixed to the duct 12 through the securing ring 878 and serves as the pair of seals. When the rim 16 rotates around the propeller axis A2 with respect to the duct 12, the rim 16 and the seal 877 relatively rotate around the propeller axis A2 in a state in which the seal 877 is in close contact with the rim 16.

The space between the inner peripheral surface of the duct 12 and the outer peripheral surface of the rim 16 is filled with a lubricant. The front seal 877 and the front securing ring 878 close a gap between the front end of the rim 16 and the duct 12 in the axial direction, whereas the rear seal 877 and the rear securing ring 878 close a gap between the rear end of the rim 16 and the duct 12 in the axial direction. Therefore, the space between the inner peripheral surface of the duct 12 and the outer peripheral surface of the rim 16 is sealed by the dust-proof structure 876. Therefore, the lubricant is prevented from leaking from between the duct 12 and the rim 16. Additionally, foreign substances, such as small stones or water, are prevented from entering the space between the duct 12 and the rim 16.

On the other hand, the dust-proof structure 876 shown in FIG. 21B includes two dust-proof rings 879 spaced apart in the front-rear direction. The dust-proof ring 879 is fixed to the duct 12. The front dust-proof ring 879 extends rearwardly from the inside of the front end of the duct 12. A gap G1 in the axial direction is provided between the rear end of the front dust-proof ring 879 and the front end of the duct 12. Likewise, the rear dust-proof ring 879 extends forwardly from the inside of the rear end of the duct 12. A gap G1 in the axial direction is provided between the front end of the rear dust-proof ring 879 and the rear end of the duct 12.

As shown in FIG. 21B, the front dust-proof ring 879 includes a plurality of slits 880 that extend forwardly from its rear end. Likewise, the rear dust-proof ring 879 includes a plurality of slits 880 that extend rearwardly from its front end. The slits 880 are arranged at equal intervals in the circumferential direction. As shown in FIG. 22, the slit 880 is disposed between two oblique surfaces 881 that face each other in the circumferential direction. The slit 880 leads to a space between the inner peripheral surface of the duct 12 and the outer peripheral surface of the rim 16. A minimum gap G2 of the dust-proof ring 879 (i.e., a minimum width of the slit 880) is narrower than a minimum gap G1 in the axial direction between the dust-proof ring 879 and the rim 16. Additionally, the minimum gap G1 in the axial direction between the dust-proof ring 879 and the rim 16 is narrower than a minimum gap G3 between the duct 12 and the rim 16.

Water that has entered the inside of the duct 12 passes through the gap G1 between one of the two dust-proof rings 879 and the rim 16 and through the gap G2 of one of the two dust-proof rings 879, and flows into the space between the inner peripheral surface of the duct 12 and the outer peripheral surface of the rim 16. Thereafter, this water passes through the gap G1 between the other dust-proof ring 879 and the rim 16 and through the gap G2 of the other dust-proof ring 879, and flows out from the space between the inner peripheral surface of the duct 12 and the outer peripheral surface of the rim 16. The dust-proof rings 879 and the rim 16 prevent foreign substances greater in size than the gaps G1 and G2 from entering the space between the inner peripheral surface of the duct 12 and the outer peripheral surface of the rim 16. Additionally, the gap G1 and the gap G2 are narrower than the gap G3 between the duct 12 and the rim 16, and therefore foreign substances greater in size than the gap G3 can be prevented from entering the space between the duct 12 and the rim 16 and obstructing the rotation of the rim 16. Still additionally, water flows through the space between the duct 12 and the rim 16, and therefore small foreign substances that exist between the duct 12 and the rim 16 can be discharged by a water stream.

Next, a ninth preferred embodiment of the present invention will be described.

A main difference between the ninth preferred embodiment and the first preferred embodiment is that an illuminant that emits light is disposed on the propeller.

Figure 23:
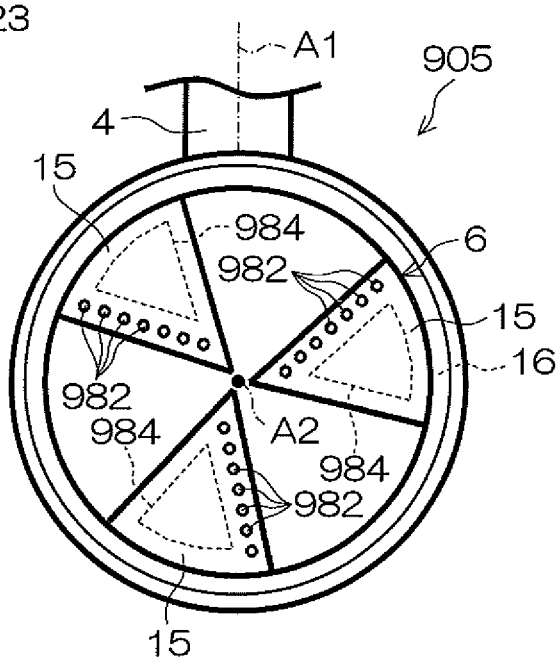
FIG. 23 is a rear view of a propulsion unit according to a ninth preferred embodiment of the present invention.
Figure 24A:
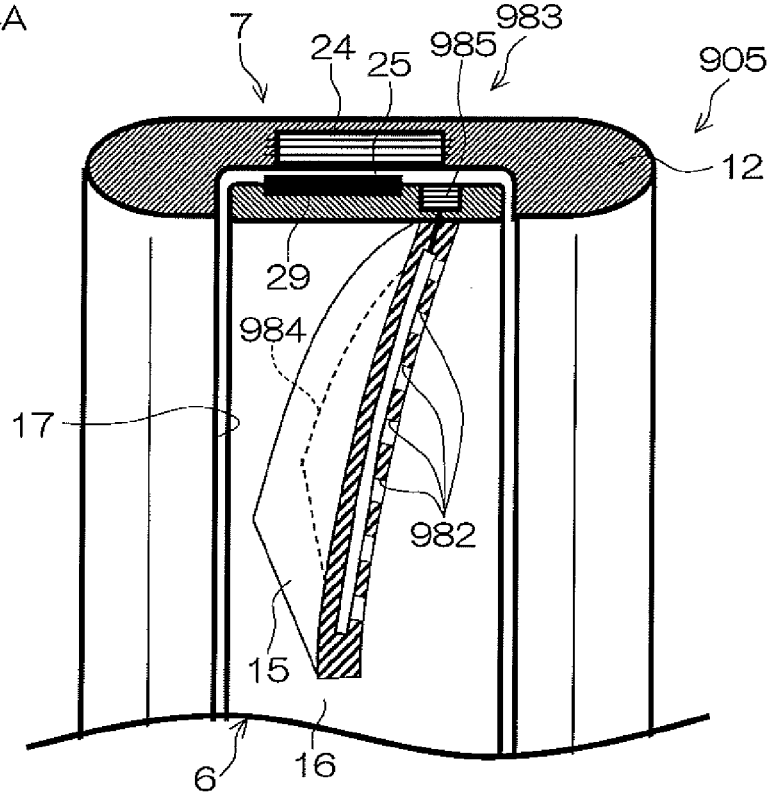
FIG. 24A is a sectional view of a portion of the propulsion unit according to the ninth preferred embodiment of the present invention.
Figure 24B:
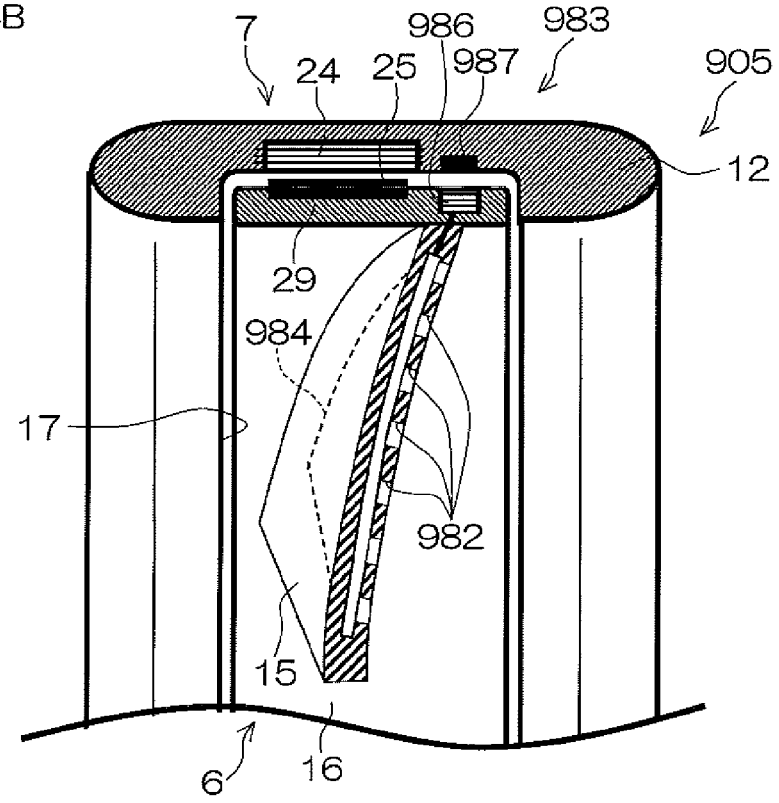
FIG. 24B is a sectional view of the portion of the propulsion unit according to the ninth preferred embodiment of the present invention.

FIG. 23 is a rear view of a propulsion unit 905 according to the ninth preferred embodiment of the present invention. FIG. 24A and FIG. 24B are sectional views of a portion of the propulsion unit 905 according to the ninth preferred embodiment of the present invention. In FIG. 23 to FIG. 24B, the same reference numerals as in FIGS. 1 to 22 are given to the components corresponding to the components shown in FIGS. 1 to 22, and a description of these components is omitted.

The propulsion unit 905 according to the ninth preferred embodiment includes the same arrangement as the propulsion unit 5 according to the first preferred embodiment. Specifically, the propulsion unit 905 includes a plurality of illuminants 982 each of which emits light, a power generator 983 that generates electric power, and a plurality of substrates (flexible printed boards) 984 that supply electric power from the power generator 983 to the illuminants 982 in addition to the arrangement of the propulsion unit 5 according to the first preferred embodiment. The illuminant 982 may be an electric lamp, or may be an LED (light emitting diode). As shown in FIG. 23, each blade 15 holds the illuminants 982. The illuminants 982 held by the one shared blade 15 are arranged to define a linear row that extends in the radial direction.

As shown in FIG. 24A and FIG. 24B, the illuminant 982 is embedded in the blade 15, and a portion of the illuminant 982 is exposed from the back surface of the blade 15. The substrates 984 are embedded in the blades 15, respectively. The substrate 984 is electrically connected to the illuminants 982 held by the shared blade 15. Additionally, the substrate 984 is electrically connected to the power generator 983. An electric circuit that controls electric power to be supplied to the illuminants 982 is mounted on the substrate 984. The substrate 984 allows the illuminants 982 to emit light by supplying electric power from the power generator 983 to the illuminants 982. The power generator 983 may be arranged to include power generation coils 985 shown in FIG. 24A, or may be arranged to include power generation coils 986 and power generation magnets 987 shown in FIG. 24B.

In detail, the power generator 983 shown in FIG. 24A includes a plurality of power generation coils 985 attached to the rim 16. Each power generation coil 985 is attached to the rim 16 at a position at which it faces the stator 24. The power generation coils 985 rotate around the propeller axis A2 together with the rim 16. When the electric motor 7 rotates the propeller 6, the stator 24, and the power generation coils 985 relatively rotate, and a magnetic flux passing through the power generation coils 985 changes. Therefore, an electric current (induced current) is generated in the power generation coils 985. Therefore, the illuminants 982 emit light when the electric motor 7 rotates the propeller 6.

The substrate 984 changes the light emission state of the illuminant 982 in accordance with a current value generated in the power generation coils 985. An electric current generated in the power generation coils 985 changes in accordance with the rotation speed of the propeller 6. Additionally, when the propeller 6 is rotated with high torque, electric power supplied to the stator 24 is greater than with a low torque even if the rotation speed of the propeller 6 is the same, and therefore the electric current generated in the power generation coils 985 is increased. Therefore, the light emission state of the illuminant 982 changes in accordance with a rotation state of the propeller 6 including its rotation speed and torque.

On the other hand, the power generator 983 shown in FIG. 24B includes a plurality of power generation coils 986 attached to the rim 16 and a plurality of power generation magnets 987 attached to the duct 12. Each power generation coil 986 and each power generation magnet 987 face each other in the radial direction. The power generation coils 986 rotate around the propeller axis A2 together with the rim 16. When the electric motor 7 rotates the propeller 6, the power generation coils 986 and the power generation magnets 987 relatively rotate, and a magnetic flux passing through the power generation coils 986 changes. Therefore, an electric current is generated in the power generation coils 986. Therefore, the illuminants 982 emit light when the electric motor 7 rotates the propeller 6. A light emission state of each illuminant 982 changes in accordance with a rotation state of the propeller 6.

Next, a tenth preferred embodiment of the present invention will be described.

A main difference between the tenth preferred embodiment and the second preferred embodiment is that illuminants each of which emits light are disposed at the duct and at the fixed blades.

Figure 25:
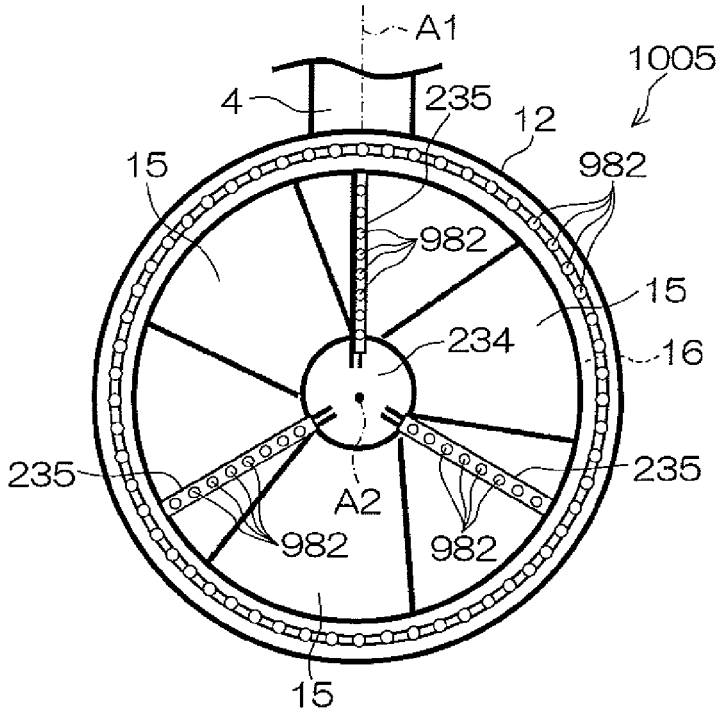
FIG. 25 is a rear view of a propulsion unit according to a tenth preferred embodiment of the present invention.
Figure 26A:
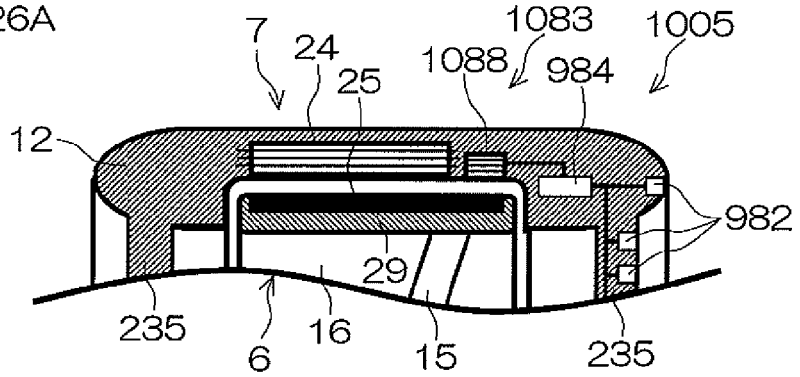
FIG. 26A is a sectional view of an outer peripheral portion of the propulsion unit according to the tenth preferred embodiment of the present invention.
Figure 26B:
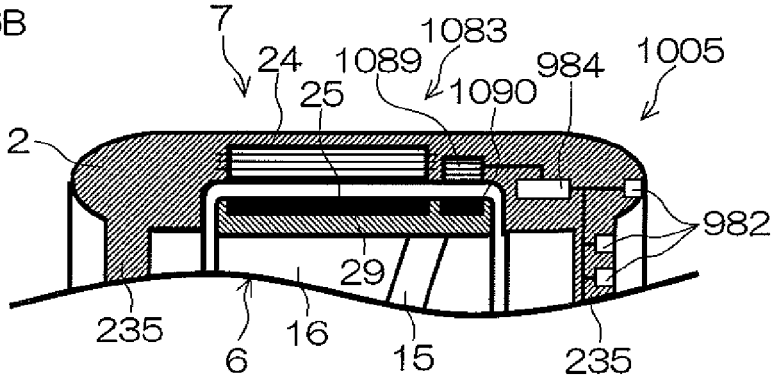
FIG. 26B is a sectional view of the outer peripheral portion of the propulsion unit according to the tenth preferred embodiment of the present invention.

FIG. 25 is a rear view of a propulsion unit 1005 according to the tenth preferred embodiment of the present invention. FIG. 26A and FIG. 26B are sectional views of an outer peripheral portion of the propulsion unit 1005 according to the tenth preferred embodiment of the present invention. In FIG. 25 to FIG. 26B, the same reference numerals as in FIGS. 1 to 24B are given to the components corresponding to the components shown in FIGS. 1 to 24B, and a description of these components is omitted.

The propulsion unit 1005 according to the tenth preferred embodiment preferably includes the same arrangement as the propulsion unit 205 according to the second preferred embodiment. Specifically, the propulsion unit 1005 includes a plurality of illuminants 982 each of which emits light, a power generator 1083 that generates electric power, and a plurality of substrates 984 that supply electric power from the power generator 1083 to the illuminants 982 in addition to the arrangement of the propulsion unit 205 according to the second preferred embodiment. As shown in FIG. 25, the duct 12 and the fixed blades 235 hold the illuminants 982. The illuminants 982 held by the duct 12 are disposed annularly along the back surface of the duct 12. The illuminants 982 held by each of the fixed blades 235 are arranged to define a linear row that extends in the radial direction.

As shown in FIG. 26A and FIG. 26B, the illuminants 982 are embedded in the duct 12 and the fixed blades 235, and a portion thereof is exposed from the back surface of the duct 12 and from the back surface of each fixed blade 235. The substrates 984 are embedded in the duct 12 and the fixed blades 235. The substrates 984 are electrically connected to the illuminants 982. The substrates 984 are also electrically connected to the power generator 1083. The substrates 984 allow the illuminants 982 to emit light by supplying electric power from the power generator 1083 to the illuminants 982. The power generator 1083 may be arranged to include power generation coils 1088 shown in FIG. 26A, or may be arranged to include power generation coils 1089 and power generation magnets 1090 shown in FIG. 26B.

In detail, the power generator 1083 shown in FIG. 26A includes a plurality of power generation coils 1088 attached to the duct 12. Each power generation coil 1088 is attached to the duct 12 at a position at which it faces the magnet 29 of the rotor 25. The magnets 29 and the power generation coils 1088 relatively rotate when the electric motor 7 rotates the propeller 6, and a magnetic flux passing through the power generation coils 1088 changes. Therefore, an electric current is generated in the power generation coils 1088. Therefore, each illuminant 982 emits light when the electric motor 7 rotates the propeller 6. A light emission state of each illuminant 982 changes in accordance with a rotation state of the propeller 6.

On the other hand, the power generator 1083 shown in FIG. 26B includes a plurality of power generation coils 1089 attached to the duct 12 and a plurality of power generation magnets 1090 attached to the rim 16. Each power generation coil 1089 and each power generation magnet 1090 face each other in the radial direction. The power generation magnets 1090 rotate around the propeller axis A2 together with the rim 16. When the electric motor 7 rotates the propeller 6, the power generation coils 1089 and the power generation magnets 1090 relatively rotate, and a magnetic flux passing through the power generation coils 1089 changes. Therefore, an electric current is generated in the power generation coils 1089. Therefore, each illuminant 982 emits light when the electric motor 7 rotates the propeller 6. A light emission state of each illuminant 982 changes in accordance with a rotation state of the propeller 6.

Although the first to tenth preferred embodiments of the present invention have been described as above, the present invention is not limited to the contents of the first to tenth preferred embodiments, and can be variously modified within the scope of the appended claims.

For example, the electric motor preferably is a radial gap motor including a stator and a rotor both of which face each other in the radial direction in the first to tenth preferred embodiments as described above. However, the electric motor may be an axial gap motor including a stator and a rotor both of which face each other in the axial direction.

Additionally, at least two of the arrangements of the first to tenth preferred embodiments may be combined together. For example, the rotational shaft is not disposed in the center of the propeller in the third preferred embodiment as described above. However, the rotational shaft of the propeller according to the second preferred embodiment may be disposed in the center of the propeller according to the third preferred embodiment. In other words, the arrangement according to the second preferred embodiment and the arrangement according to the third preferred embodiment may be combined together. Additionally, the illuminants are preferably not provided in the third to eighth preferred embodiments as described above. However, the illuminants according to the ninth and tenth preferred embodiments may be disposed on the propulsion unit according to the third to eighth preferred embodiments.

Additionally, the motor ECU detects the rotation angle (rotor position) of the electric motor preferably based on a detection value of the motor rotation angle detector in the first to tenth preferred embodiments as described above. However, the motor ECU may detect the rotation angle of the electric motor from the induced voltage of the electric motor. In other words, a motor rotation angle detecting portion that detects the rotation angle of the electric motor from the induced voltage of the electric motor may be disposed in the motor ECU. In this case, the motor rotation angle detector is not necessarily required to be provided.

Additionally, the steering shaft and the duct rotate around the steering axis with respect to the bracket in the first to tenth preferred embodiments as described above. However, only the duct may rotate around the steering axis with respect to the bracket. In other words, the steering shaft may be fixed to the bracket, and the duct may be connected to the steering shaft rotatably around the steering axis with respect to the steering shaft.

Additionally, electric power from the power generator that generates electric power in response to the rotation of the propeller is preferably supplied to the illuminants in the tenth preferred embodiment as described above. However, the power generator is not necessarily required to be provided if the illuminants are disposed on the fixing portion (duct) as in the tenth preferred embodiment. In other words, electric power from the motor power source (battery) that supplies electric power to the electric motor may be supplied to the illuminants. In this case, the motor ECU may control a light emission state of the illuminants by controlling the power supply to the illuminants.

The present application corresponds to Japanese Patent Application No. 2011-244661 filed in the Japan Patent Office on Nov. 8, 2011, and the entire disclosure of the application is incorporated herein by reference.

Although the preferred embodiments of the present invention have been described in detail as above, these are merely specific examples used to clarify the technical contents of the present invention, and the present invention is not to be understood as being limited to these specific examples, and the scope of the present invention is to be determined solely by the appended claims.

What is claimed is:

1. An outboard motor comprising:

a transom bracket that is attachable to a marine vessel;

a duct that is rotatable around a vertical or substantially vertical steering axis with respect to the transom bracket;

a propeller that is rotatable with respect to the duct around a propeller axis extending in a direction perpendicular or substantially perpendicular to the steering axis, the propeller including a plurality of blades and a rim that surrounds the plurality of blades, the propeller being surrounded by the duct;

an electric motor that rotates the propeller by rotating the rim with respect to the duct;

a control unit mounted in the outboard motor, the control unit being connected to the electric motor and configured to control the electric motor; and an output adjusting device connected to the control unit and being configured to perform an output adjustment of the outboard motor.

2. The outboard motor according to claim 1, wherein the electric motor includes a stator defined by at least one portion of the duct and a rotor defined by at least one portion of the rim.

3. The outboard motor according to claim 2, wherein the rim includes a magnet that defines at least one portion of the rotor.

4. The outboard motor according to claim 2, wherein the electric motor is a reluctance motor.

5. The outboard motor according to claim 1, further comprising a gear transmission mechanism that transmits power of the electric motor to the rim, wherein the gear transmission mechanism includes a driving gear that rotates together with the electric motor and a driven gear to which rotation of the driving gear is transmitted and that rotates together with the rim.

6. The outboard motor according to claim 1, wherein the propeller includes a front propeller and a rear propeller that are rotationally driven in mutually opposite directions by the electric motor;

the front propeller and the rear propeller are arranged side-by-side in a direction along the propeller axis;

the front propeller includes a plurality of front blades and a front rim that surrounds the plurality of front blades; and the rear propeller includes a plurality of rear blades and a rear rim that surrounds the plurality of rear blades.

7. The outboard motor according to claim 6, wherein the electric motor includes a front electric motor that rotates the front propeller by rotating the front rim with respect to the duct and a rear electric motor that rotates the rear propeller by rotating the rear rim with respect to the duct;

the front electric motor includes a front stator defined by at least one portion of the duct and a front rotor defined by at least one portion of the front rim; and the rear electric motor includes a rear stator defined by at least one portion of the duct and a rear rotor defined by at least one portion of the rear rim.

8. The outboard motor according to claim 6, further comprising a gear transmission mechanism that transmits power of the electric motor to the front rim and to the rear rim, wherein the gear transmission mechanism includes a driving gear that rotates together with the electric motor, a front driven gear to which rotation of the driving gear is transmitted and that rotates together with the front rim, and a rear driven gear to which rotation of the driving gear is transmitted and that rotates together with the rear rim.

9. The outboard motor according to claim 1, wherein the rim includes a front rim and a rear rim that support the plurality of blades so that an inclination angle of the plurality of blades with respect to the propeller axis changes in accordance with relative rotation around the propeller axis;

the front rim and the rear rim are arranged side-by-side in a direction along the propeller axis;

the electric motor includes a front electric motor that rotates the front rim around the propeller axis and a rear electric motor that rotates the rear rim around the propeller axis; and a pitch of the propeller is changed by relatively rotating the front rim and the rear rim around the propeller axis.

10. The outboard motor according to claim 9, further comprising a control device that is programmed to control the pitch of the propeller by controlling the front electric motor and the rear electric motor.

11. The outboard motor according to claim 9, further comprising a rotation amount restricting portion that restricts a relative rotation amount of the front rim and the rear rim.

12. The outboard motor according to claim 11, wherein the rotation amount restricting portion includes a supporting portion disposed at either one of the rim and the plurality of blades and a supported portion that is disposed at a remaining one of the rim and the plurality of blades and that defines a hole in which the supporting portion is inserted.

13. The outboard motor according to claim 11, wherein the propeller further includes a front rotational shaft that extends along the propeller axis and that rotates around the propeller axis together with the front rim and a rear rotational shaft that extends along the propeller axis and that rotates around the propeller axis together with the rear rim; and the rotation amount restricting portion includes a front engagement portion and a rear engagement portion that are disposed at the front rotational shaft and at the rear rotational shaft, respectively, and that engage with each other so as to be relatively rotatable around the propeller axis in a predetermined angular range.

14. The outboard motor according to claim 1, further comprising a steering shaft that extends along the steering axis and that is rotatable around the steering axis with respect to the transom bracket, wherein the duct is attached to a lower portion of the steering shaft and is rotatable around the steering axis together with the steering shaft.

15. The outboard motor according to claim 1, further comprising an illuminant whose light emission state changes in accordance with a rotation state of the propeller.

16. The outboard motor according to claim 15, wherein the illuminant is disposed in at least either one of the duct and the propeller.

17. The outboard motor according to claim 15, wherein the electric motor includes a stator defined by at least one portion of the duct and a rotor defined by at least one portion of the rim;

the outboard motor further comprises a power generation coil that rotates around the propeller axis together with the rim;

the power generation coil includes at least one portion attached to the rim at a position facing the stator; and the illuminant is connected to the power generation coil and is disposed at the propeller.

18. The outboard motor according to claim 15, further comprising:

a power generation coil that is attached to the rim and that rotates around the propeller axis together with the rim; and a power generation magnet that is attached to the duct and that faces the power generation coil; wherein the illuminant is connected to the power generation coil and is disposed at the propeller.

* * * * *